US006041196A

United States Patent [19]

Nakagawa et al.

[11] Patent Number: 6,041,196

[45] Date of Patent: Mar. 21, 2000

[54] DEVELOPER DETECTING APPARATUS FOR DETECTING THE POSITION OF AN UPPER SURFACE OF DEVELOPER CONTAINED IN A CONTAINER AND PROCESS CARTRIDGE COMPRISING SUCH APPARATUS

[75] Inventors: Takao Nakagawa, Numazu; Tadayuki Tsuda, Susono, both of Japan

[73] Assignee: Canon Kabushiki Kaisha, Tokyo, Japan

[21] Appl. No.: 09/178,502

[22] Filed: Oct. 26, 1998

[30] Foreign Application Priority Data

| | | | |
|---|---|---|---|
| Oct. 27, 1997 | [JP] | Japan | 9-293967 |
| Oct. 29, 1997 | [JP] | Japan | 9-296983 |
| Dec. 11, 1997 | [JP] | Japan | 9-341705 |

[51] Int. Cl.[7] ..... G03G 15/08

[52] U.S. Cl. ..... 399/27

[58] Field of Search ..... 399/111, 61, 62, 399/27, 30, 258, 262

[56] References Cited

U.S. PATENT DOCUMENTS

| | | | |
|---|---|---|---|
| 4,592,642 | 6/1986 | Imaizumi et al. | 399/27 |
| 4,632,534 | 12/1986 | Shimono | 399/27 |
| 4,947,788 | 8/1990 | Hill et al. | 399/62 X |
| 5,126,800 | 6/1992 | Shishido et al. . | |
| 5,196,886 | 3/1993 | Nakane et al. | 399/27 |
| 5,208,634 | 5/1993 | Ikemoto et al. . | |
| 5,223,893 | 6/1993 | Ikemoto et al. . | |
| 5,294,960 | 3/1994 | Nomura et al. . | |
| 5,331,372 | 7/1994 | Tsuda et al. . | |
| 5,345,294 | 9/1994 | Nomura et al. . | |
| 5,404,198 | 4/1995 | Noda et al. . | |
| 5,428,427 | 6/1995 | Lee | 399/30 |
| 5,470,635 | 11/1995 | Shirai et al. . | |
| 5,475,470 | 12/1995 | Sasago et al. . | |
| 5,488,459 | 1/1996 | Tsuda et al. . | |
| 5,510,878 | 4/1996 | Noda et al. . | |
| 5,583,613 | 12/1996 | Kobayashi et al. . | |
| 5,602,623 | 2/1997 | Nishibata et al. . | |
| 5,608,509 | 3/1997 | Shirai et al. . | |
| 5,623,328 | 4/1997 | Tsuda et al. . | |
| 5,659,847 | 8/1997 | Tsuda et al. . | |
| 5,669,042 | 9/1997 | Kobayashi et al. . | |
| 5,802,419 | 9/1998 | Sakurai et al. | 399/27 X |
| 5,809,374 | 9/1998 | Tsuda et al. . | |
| 5,812,909 | 9/1998 | Oguma et al. . | |
| 5,828,928 | 10/1998 | Sasago et al. . | |
| 5,873,012 | 2/1999 | Miyabe et al. | 399/111 X |
| 5,923,918 | 7/1999 | Nakawaga et al. | 399/27 |

*Primary Examiner*—Susan S. Y. Lee

*Attorney, Agent, or Firm*—Fitzpatrick, Cella, Harper & Scinto

[57] ABSTRACT

An apparatus for detecting the amount of developer includes an agitation member for agitating developer contained in a developer container, and a detection member for detecting the position of the upper surface of the developer contained in the developer container, and interlocked with the agitating operation of the agitation member, the detection member is made movable above the upper surface of the developer. With the structure thus arranged, the remaining of the developer can be detected exactly even when the remaining developer become very small. Also, with the structure thus arranged, the operation of the detection member is finished in a position not to hinder the agitating operation of the agitation member, thus enabling the agitation member to continue its normal operation after the detection of the remaining developer is finished.

17 Claims, 20 Drawing Sheets

DEVELOPER DETECTING APPARATUS FOR DETECTING THE POSITION OF AN UPPER SURFACE OF DEVELOPER CONTAINED IN A CONTAINER AND PROCESS CARTRIDGE COMPRISING SUCH APPARATUS

BACKGROUND OF THE INVENTION

1. Field of the Invention

The present invention relates to an apparatus for detecting the amount of developer that detects such amount in the developer containers of a developing device used for an image formation apparatus of a copying machine or a laser beam printer that adopts the electrophotographing method. The invention also relates to a process cartridge using this developer amount detection apparatus.

In this respect, the process cartridge comprises at least one of developing means serving as processing means, electrostatic charging means and cleaning means, and an electrophotographic photosensitive body. These are arranged integrally in the form of a cartridge, and then, this cartridge is made detachably mountable on the main body of the image formation apparatus.

2. Related Background Art

Conventionally, it is required for the image formation apparatus: such as a copying machine, to replace the photosensitive drum that serves as the image carrier as well as the developing device in order to supply the toner that serve as developer; to clean the discharge wires of the electrostatic charger; to exchange the cleaning containers in which the waste toner is accumulated; and to adjust or replace devices around the photosensitive drum when the image formation apparatus is used for a long time.

However, special skills and knowledge are needed for carrying out such maintenance as described above, making it rather difficult for a general user to execute it.

Therefore, it has been proposed and put into practice that the photosensitive drum and the developing device, the electrostatic charger, and the processing device such as the cleaning equipment, are integrally assembled in a cartridge container, and that such cartridge is detachably mounted on the main body of an image formation apparatus as a process cartridge. In this manner, when there is a need for the maintenance of the processing equipment, the entire body of the process cartridge is replaced to make it easier to implement the intended maintenance.

Now, however, the process cartridge should be replaced with a new cartridge when the toner retained in it in advance is completely consumed. Here, therefore, the arrangement is made so that the user is able to determine the remaining toner at all times and take precaution against any sudden shortage of toner.

In this respect, a toner amount detection apparatus is arranged in the interior of a toner container to detect the amount of toner in the toner container. FIG. 5 to FIG. 7 illustrate one example of the toner amount detection apparatus.

In other words, FIG. 5 is a cross-sectional view which shows the process cartridge provided with such toner amount detection apparatus. FIG. 6 is a view which shows the main part of the toner amount detection apparatus. FIG. 7 is a cross-sectional view taken along line 7—7 in FIG. 6. The toner amount detection apparatus adapts the method to enable the float 11, which is a member for detecting the position for the amount of developer, which is supported by a rotational float arm 12, in order to follow the shifting upper surface position of the toner, hence detecting the toner remainders continuously.

Now, as a method for holding the toner surface by use of the float 11, the float arm 12 is installed on the rotational float shaft 13 in the interior of the toner container 3 in accordance with this example, and a recovery lever 100 is fixed to the end portion of the float shaft 13, which is extruded outside the toner container 3. In this way, it is arranged to keep the rotated positions (rotational angles) of both of them unchanged.

Then, when the user pulls up the recovery lever 100 before the process cartridge is installed on the main body of the image formation apparatus, it is made possible for the float 11 to hold the toner surface again even if the float 11 is buried in the toner before use. When the cartridge is in use, the float 11 rotates to follow the toner surface in the direction indicated by an arrow Ya as the toner surface descends from (A) to (B).

However, there are the problems discussed below as to the toner amount detection apparatus that has been discussed above.

In other words, as the toner surface, which is held by the float 11, approaches the agitation member 4, the toner surface begins to be influenced by the agitation thereof. On the surface, undulation takes place to make it softer. Thus, the float 11 sinks into the toner eventually. This makes it impossible to detect the toner remainders exactly in the toner container 3.

Also, in order to make the detection possible even when the toner remainders become smaller still, it is conceivable to arrange the float 11 and the agitation member 4 so that their paths may cross each other by lowering the position of the float shaft 13 as shown in FIG. 8. However, if the rotational direction of the agitation member 4 is as indicated by an arrow Yb, there is the possibility that the float 11 advances excessively in the direction indicated by an arrow Ya when the agitation member 4 is in contact with the float 11. As a result, it becomes impossible to detect exactly the toner remainders in the toner container 3.

Further, as described above, if the position of the float shaft 13 is lowered to allow the paths of the float 11 and the agitation member 4 to intersect each other, the agitation member 4 tends to push away the float 11 in the direction indicated by the arrow Ya when the float abuts upon the agitation member 4 after rotating in the direction indicated by an arrow Yc at the time that the float 11 comes to a stop by abutting upon the toner container 3 as shown in FIG. 9 (because the acting point of the force exerted by the agitation member 4 on the float 11 is in the right side of the center in FIG. 9). However, since the toner container 3 does not allow the float 11 to escape anyway, the agitation member 4 can no longer operate normally once it abuts upon the float 11.

SUMMARY OF THE INVENTION

It is an object of the invention to provide an apparatus for detecting the amount of developer, which is capable of detecting it exactly all the time, and also, to provide a process cartridge provided with such apparatus.

Another object of the invention is to provide an apparatus for detecting the amount of toner, which is capable of detecting a smaller amount of residual toner, and to provide a process cartridge provided with such apparatus.

The above and other objects and features of the present invention will become apparent from the following detailed description and the appended claims with reference to the accompanying drawings.

DETAILED DESCRIPTION OF THE PREFERRED EMBODIMENTS

Hereinafter, with reference to the accompanying drawings, a description will be provided of the embodiments in accordance with the present invention.

(First Embodiment)

Figure 1:
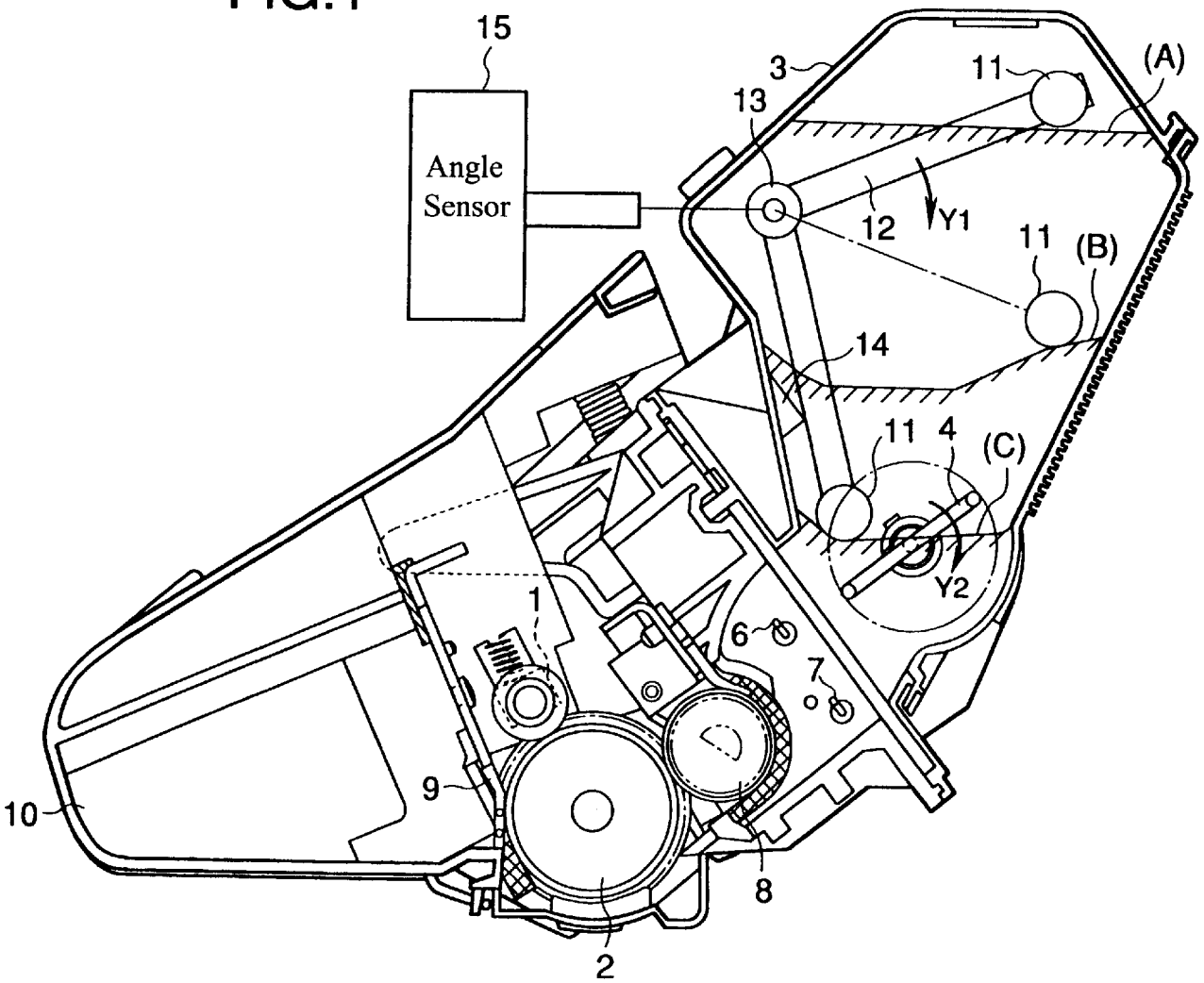
FIG. 1 is a view which shows the section of a process cartridge in accordance with a first embodiment of the present invention, and also, the state in which a float moves as toner is consumed.

FIG. 1 is a view which shows the section of a process cartridge in accordance with the present embodiment, and also, shows the state in which a float moves as toner is consumed.

The process cartridge shown in FIG. 1 comprises a photosensitive drum (electrophotographic photosensitive body) 2 which serves as an image carrier; an electrostatic charging roller 1 arranged on the circumference thereof; a developing device 5; a toner container 3; and a cleaning container 10, and some others. These are integrally structured in the form of a cartridge. The process cartridge is detachably mounted on the main body of an image formation apparatus which is not shown. Here, an agitation members 6 and 7 and a development sleeve 8 are housed in the developing device 5. Toner and an agitation member 4 are housed in the toner container 3. Also, a cleaning blade 9 is provided for the cleaning container 10.

Then, the photosensitive drum 2 rotates at a specific speed, and the surface thereof is charged evenly by use of the electrostatic charging roller 1. The image signals generated by the main body of the image formation apparatus (not shown) are converted into a laser beam which irradiates the surface of the photosensitive drum 2. Then, the electrostatic latent images are formed on the surface of the photosensitive drum 2. Then, the electrostatic latent images become apparent as the toner images, which are developed with toner by use of the developing device 5.

In other words, the toner agitated by the agitation member 4 in the toner container 3 of the developing device 5 is transferred to the developing device 5, and after being agitated further by the agitation members 6 and 7 sufficiently, the toner is supplied to the photosensitive drum 2 through the development sleeve 8 for use of the development of electrostatic latent images formed on the photosensitive drum 2. Thus, the toner images formed on the photosensitive drum 2 are transferred to a transfer material (not shown) being carried by use of a sheet feed mechanism (not shown) of the main body of the image formation apparatus. The toner, which has not been transferred and still remains on the photosensitive drum 2, is scraped off by use of the cleaning blade 9 and collected into the waste toner container 10.

Then, in accordance with the present embodiment, there is provided in the toner container 3 a toner remainders continuous detection apparatus (an apparatus for detecting the amount of developer). The toner remainders continuous detection apparatus has an elongated float shaft 13 in the direction perpendicular to the facing plane of FIG. 1. For the float shaft 13, a detection member is provided to detect the position of the upper surface of toner contained in the toner container (developer container). More precisely, one end of a float arm 12 is fixed to the one end of the float shaft 13 which reaches the interior of the toner container 3 (it may be possible to form the float shaft 13 and the float arm together as one body). To the other end of the float arm 12, the float 11 is fixed.

Also, with the other end of the float shaft 13 that extends outside the toner container 3, an angle sensor 15, such as a potentiometer, is connected to detect the rotation amount of the float 11. Here, it may be possible to adopt any one of the following structures: the angle sensor 15 is provided for the main body of the image formation apparatus; the angle sensor 15 is connected with the float shaft 13 when the process cartridge is mounted; or the angle sensor is arranged on the cartridge side so as to transmit signals to the main body of the image formation apparatus through electrical connection (not shown).

Now, a description will be provided of the movement of the toner surface and that of the float 11 following the reduction of the toner remainders in the toner container 3.

When the toner in the toner container 3 is being reduced with the executions of a development operation, the toner surface is gradually lowered in the order of (A), (B) and (C) as shown in FIG. 1. The float 11 which has held the toner surface (A) at the beginning is also rotated centering on the float shaft 13 in the direction indicated by an arrow Y1 following the lowering toner surface as the toner is consumed.

FIGS. 2A to 2D are views which illustrate the operation of the float 11 when it is positioned on the path of the agitation member 4.

Figure 2C:
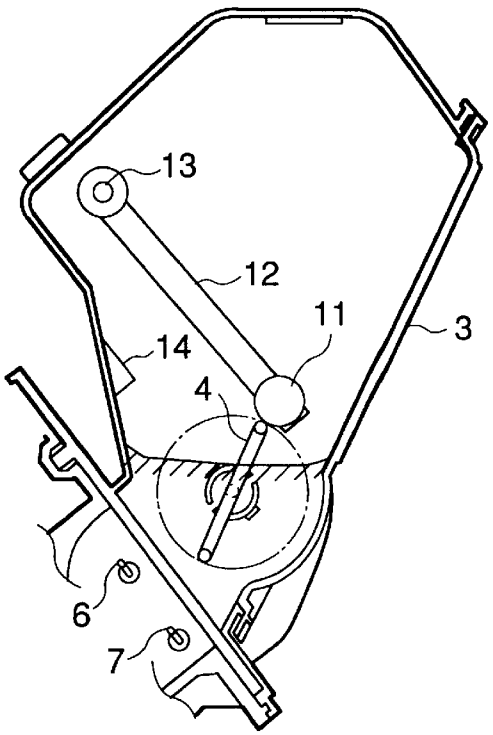
FIGS. 2A, 2B, 2C and 2D are views which illustrate the function of the toner amount detection apparatus (an apparatus for detecting the amount of developer) in accordance with the first embodiment of the present invention.
Figure 2B:
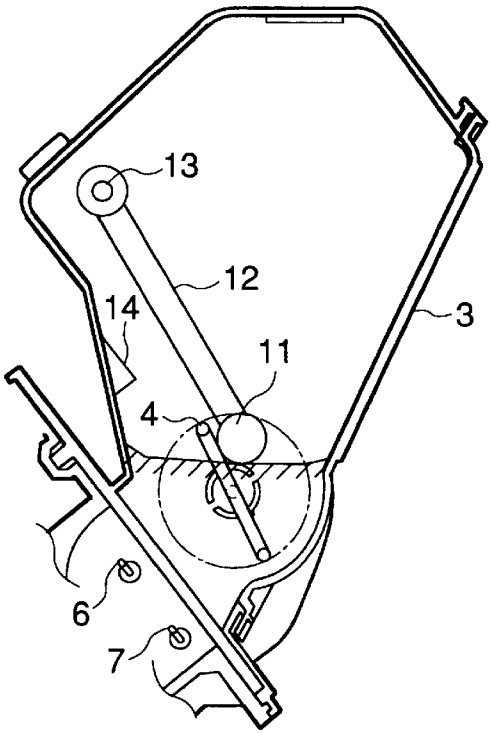
Figure 2A:
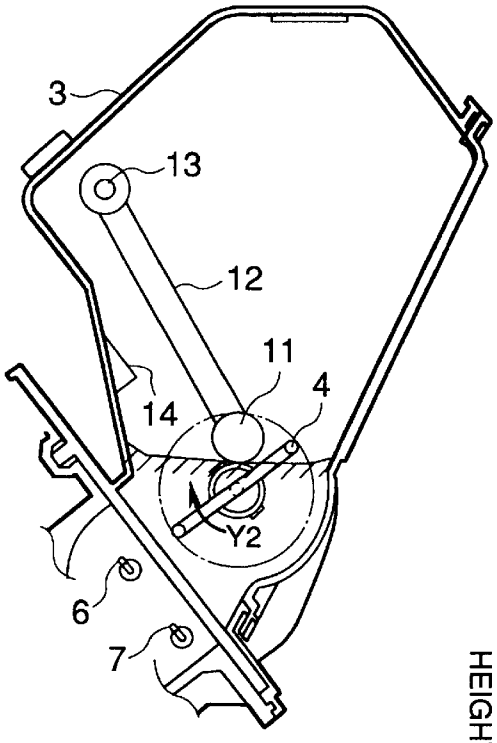

As shown in FIG. 2A, the float 11 is positioned on the passage of the agitation member 4 in a state where the float holds the toner surface. Then, the agitation member 4 continues its rotation in the same direction indicated by an arrow Y2 as the rotational direction of the float 11 (the adjustment of the rotational direction is made by use of the driving gear train (not shown) of the process cartridge). Here, as shown in FIG. 2B, the agitation member 4 abuts upon the float 11 or the float arm 12. In this state, when the agitation member 4 rotates continuously as it is, as shown in FIG. 2C, the float 11 is pushed back in the opposite direction of its path, and caused to part from the toner surface. Then, after that, when the contact between the agitation member 4 and the float 11 is released, the float 11 falls down on the toner surface again as shown in FIG. 2A. In this case, if the float 11 is formed by a light material, such as resin, the float 11 does not sink into the toner. The float is able to hold the toner surface.

Figure 2D:
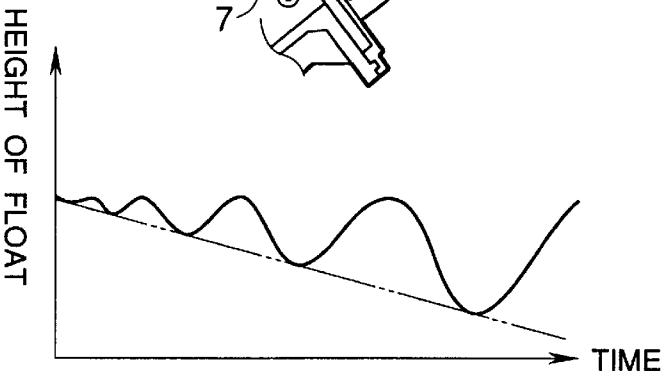

Then, as the rotation of the agitation member 4 continues, the float 11 repeats the aforesaid operation, and it swings or pivots. At this juncture, the angle sensor 15 acquires the changes of the movement of the float 11 as the periodic change of angles as shown in FIG. 2D. In this respect, it is possible to obtain the exact position of the toner surface, that is, the exact remaining amount of toner, with the computation process while holding only the minimum value (the case where the angle is made smaller).

Then, when the remaining toner in the toner container 3 is further reduced, the float 11 follows it and rotates in the direction indicated by the arrow Y1 in FIG. 1. Then, when the float arm 12 abuts upon the stopper 14 arranged in the interior of the toner container 3, the detection of the remaining toner by use of the float 11 is finished, because the toner surface is lowered to the position (C) in FIG. 1. In the position where the detection of remaining toner is finished, the float can freely move in the returning direction even if the agitation member 4 is in contact with the float 11 as far as the acting point of the force exerted by the agitation member 4 on the float 11 is on the side of the center of the float 11 in its advancing direction. Thus, the float 11 is pushed back without any problem.

As described above, in accordance with the present embodiment, there is no possibility that the float 11 is buried in the toner by being pushed back by the agitation member 4 which rotates, while being in contact with the float 11 even in such a case where the float 11 may be buried in the toner due to the upper surface of the toner, which has become softer in the toner container 3 by the influence of the agitating function of the agitation member 4 when the remaining toner in the toner container 3 is reduced more than the specific value. After that, then, when the contact between the agitation member 4 and the float 11 is released, the float 11 descends to the upper surface of the toner to hold the toner surface again. As a result, even when the remaining toner become smaller, it is possible to detect them exactly.

Also, in accordance with the present embodiment, the operation of the float 11 is finished in a position where it does not hinder the agitating operation of the agitation member 4. As a result, it is possible for the agitation member 4 to continue its agitating operation normally even after the detection of remaining toner is finished.

(Second Embodiment)

Figure 3:
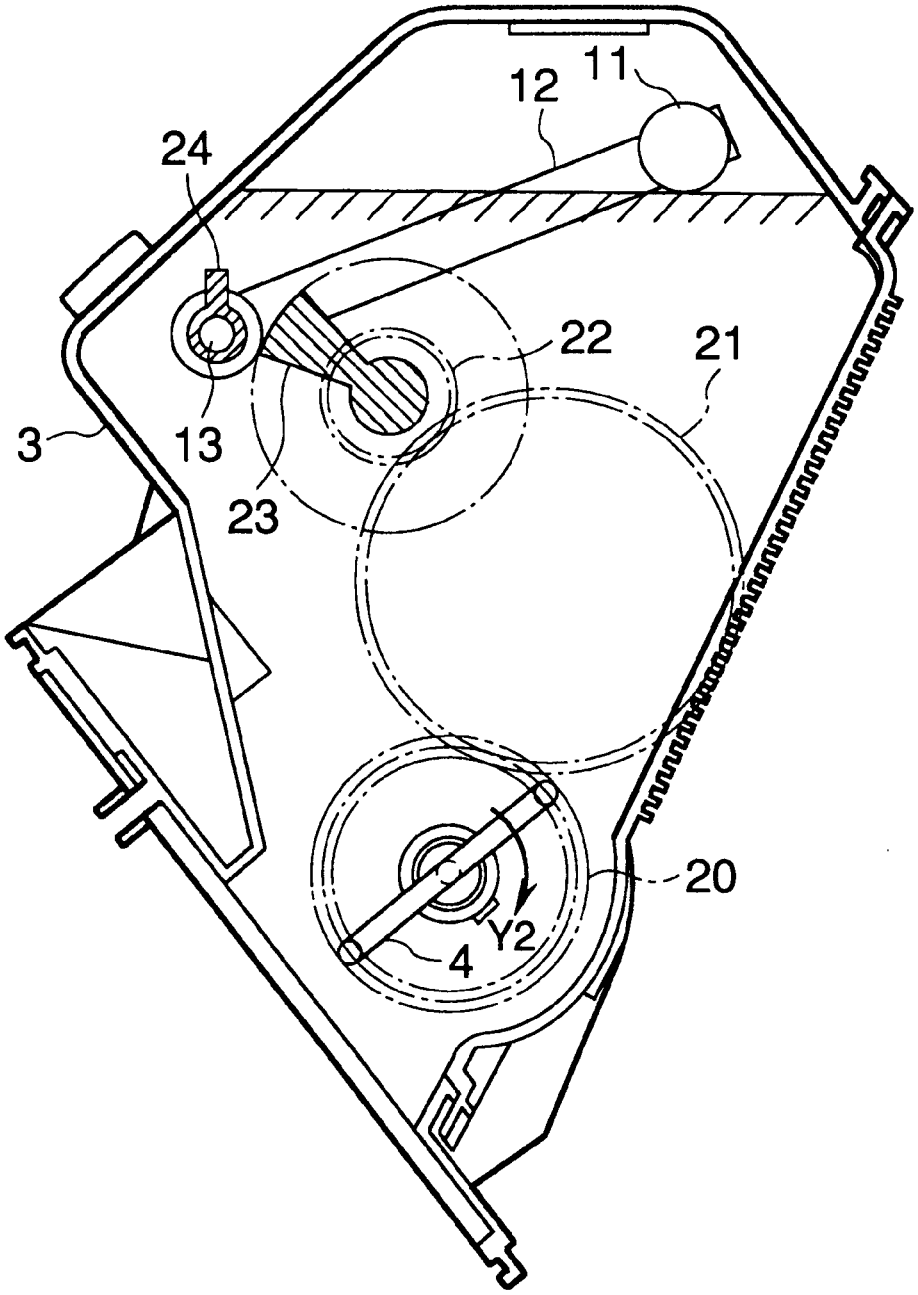
FIG. 3 is a view which shows the section of a process cartridge in accordance with a second embodiment of the present invention, and also, the state in which a float moves as toner is consumed.
Figure 4A:
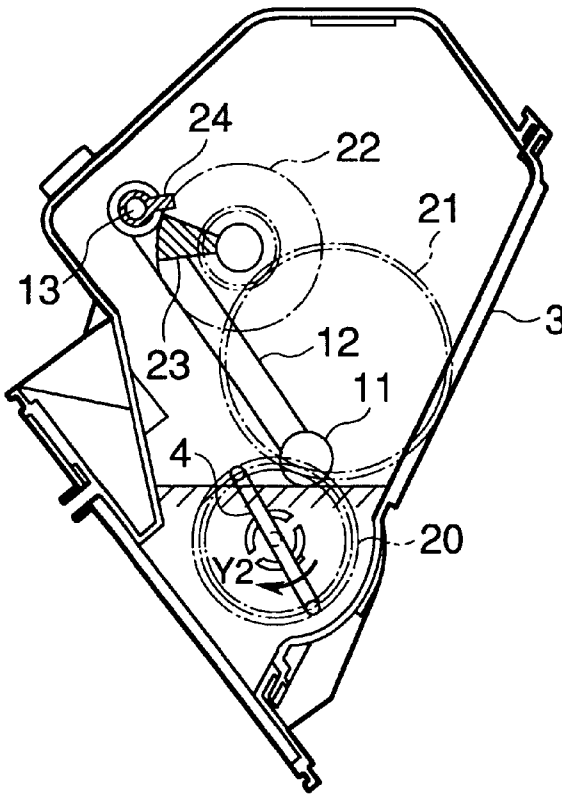
FIGS. 4A, 4B and 4C are views which illustrate the function of the toner amount detection apparatus (an apparatus for detecting the amount of developer) in accordance with a second embodiment of the present invention.
Figure 4B:
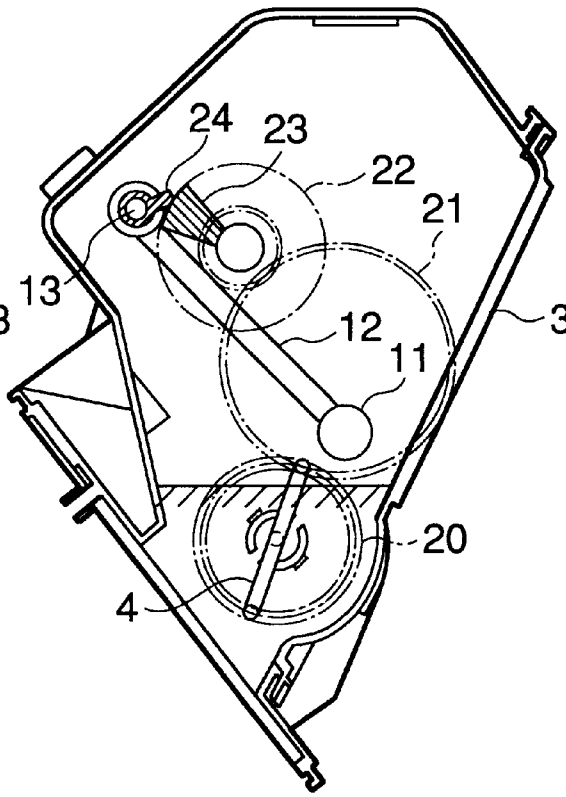
Figure 4C:
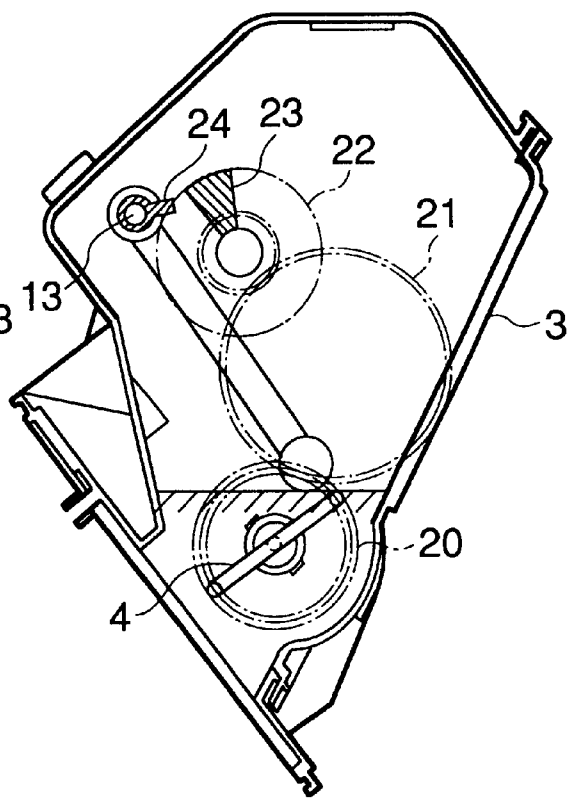
Figure 5:
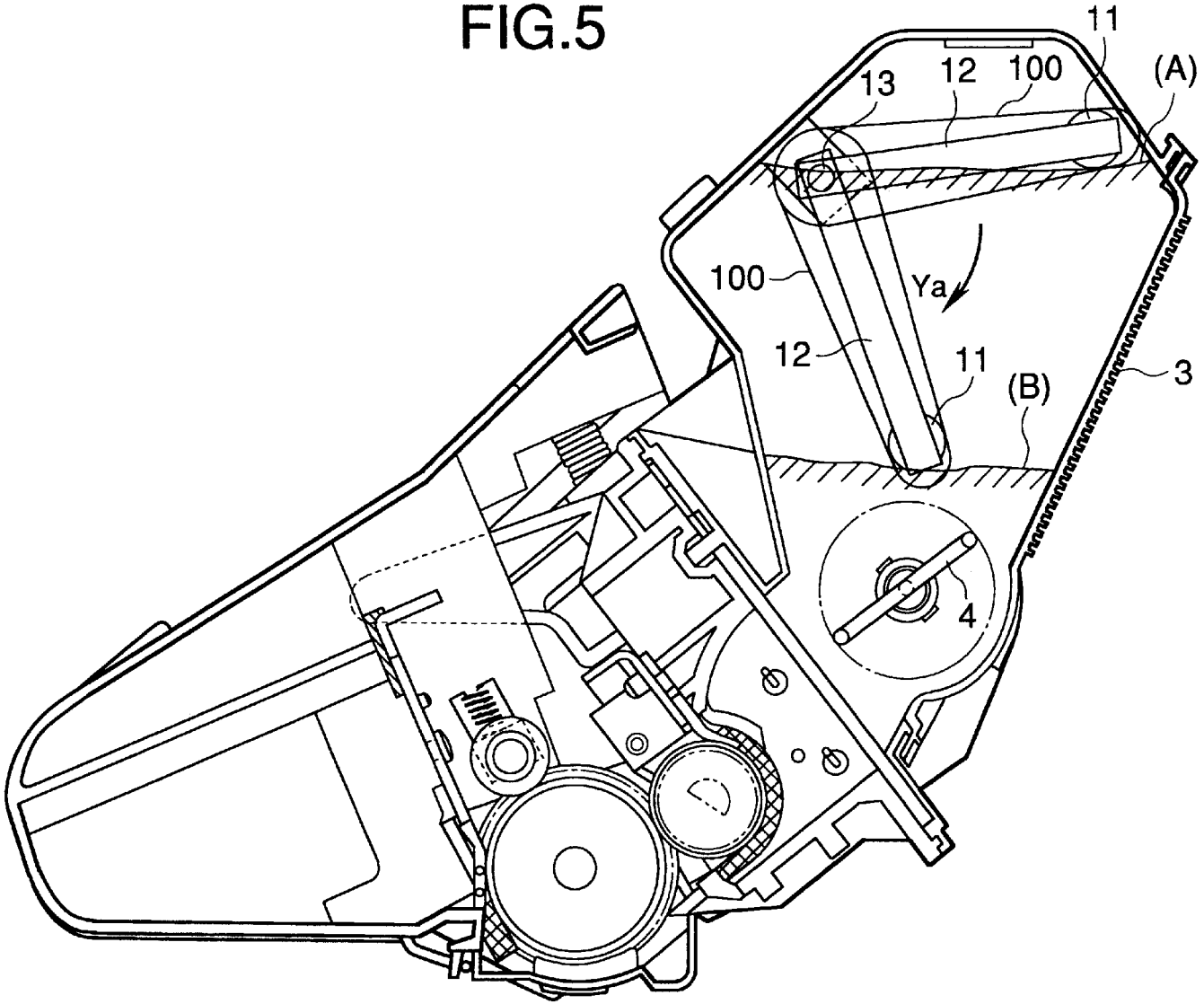
FIG. 5 is a cross-sectional view which shows a process cartridge provided with the toner amount detection apparatus (an apparatus for detecting the amount of developer).
Figure 6:
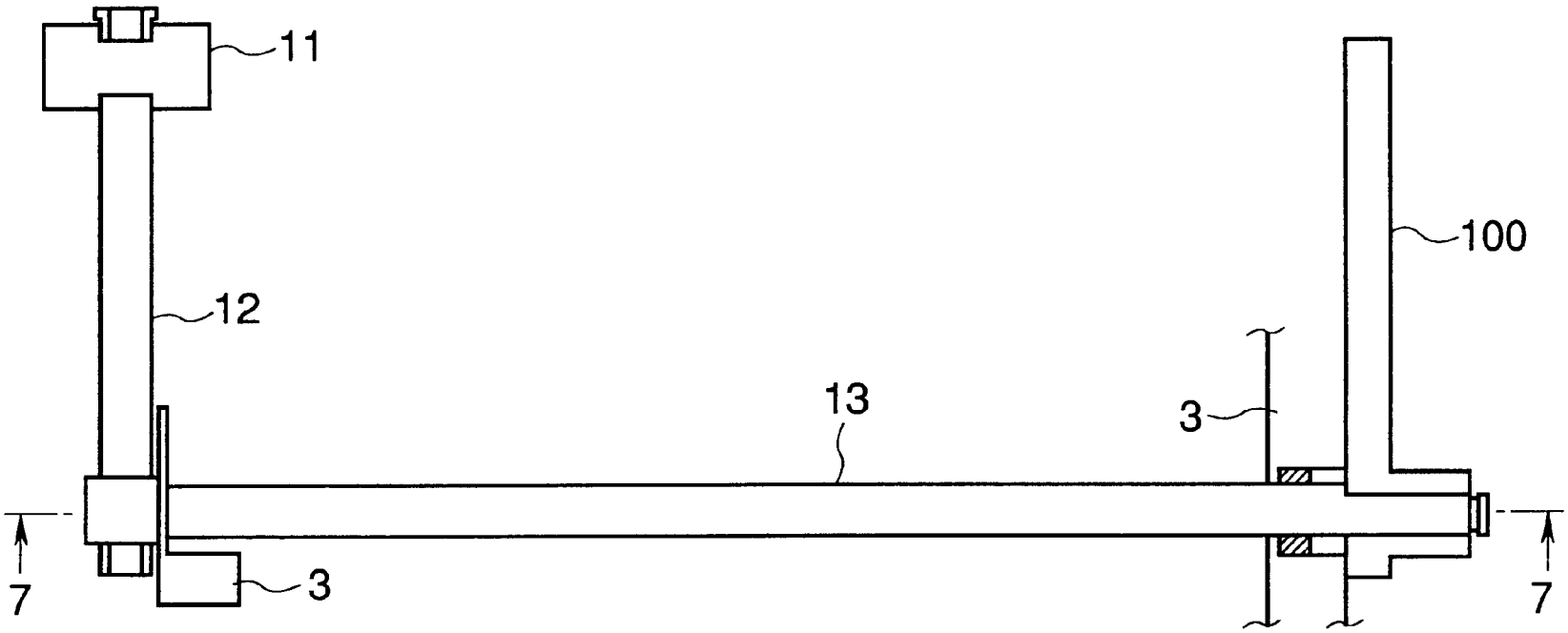
FIG. 6 is a view which shows the main part of the toner amount detection apparatus (an apparatus for detecting the amount of developer).
Figure 7:
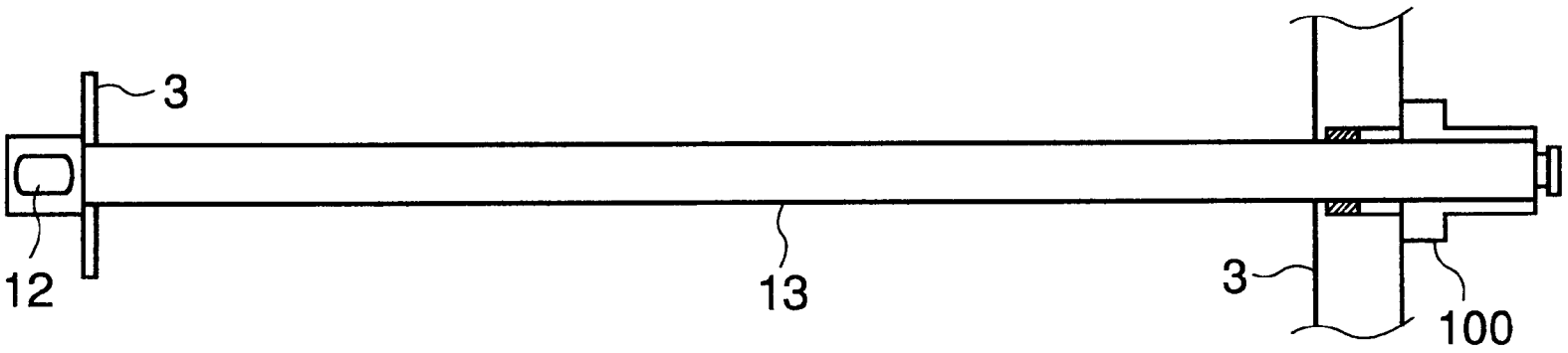
FIG. 7 is a cross-sectional view, taken along line 7—7 in FIG. 6.
Figure 8:
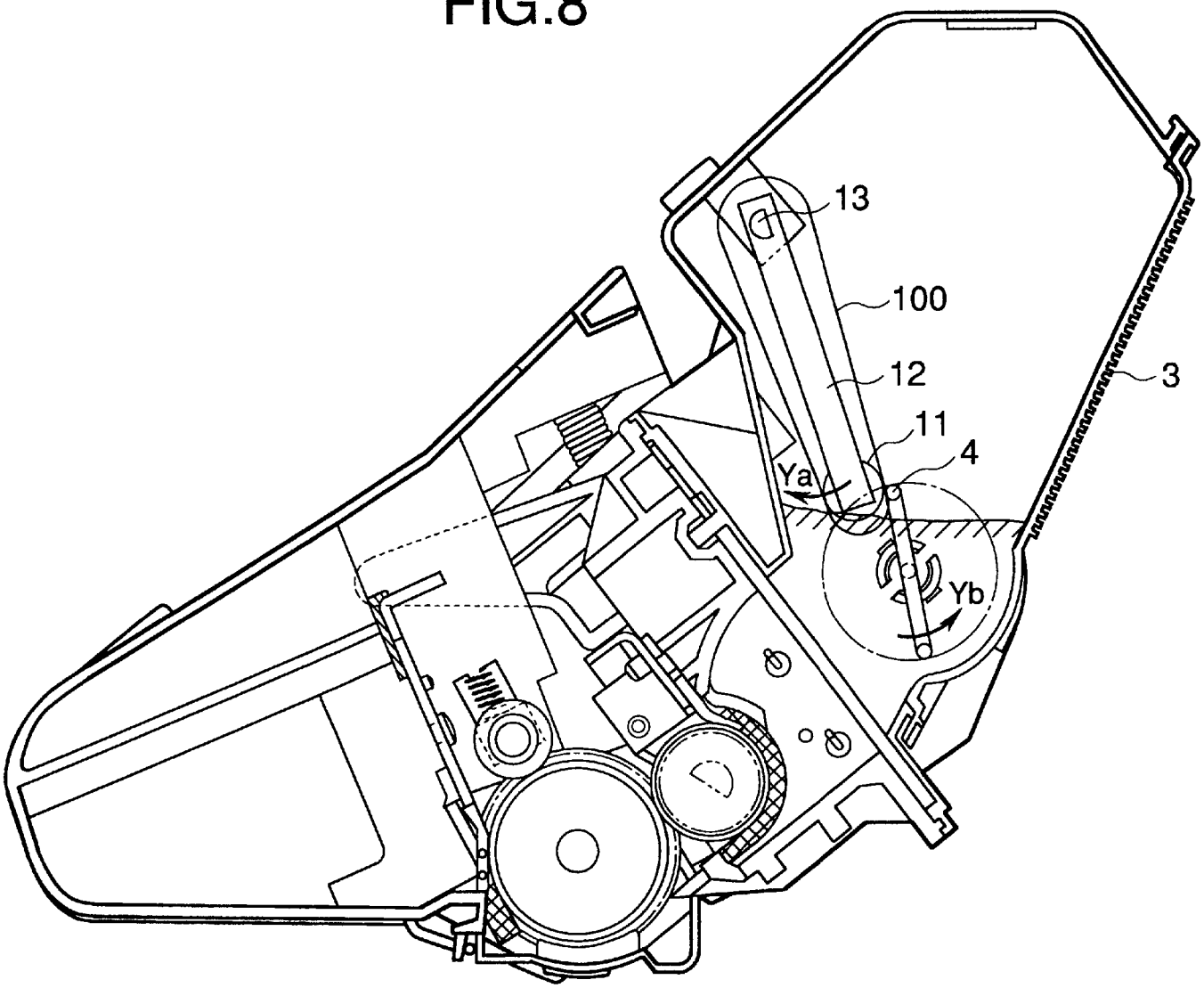
FIG. 8 is a cross-sectional view which shows a process cartridge provided with the toner amount detection apparatus (an apparatus for detecting the amount of developer).
Figure 9:
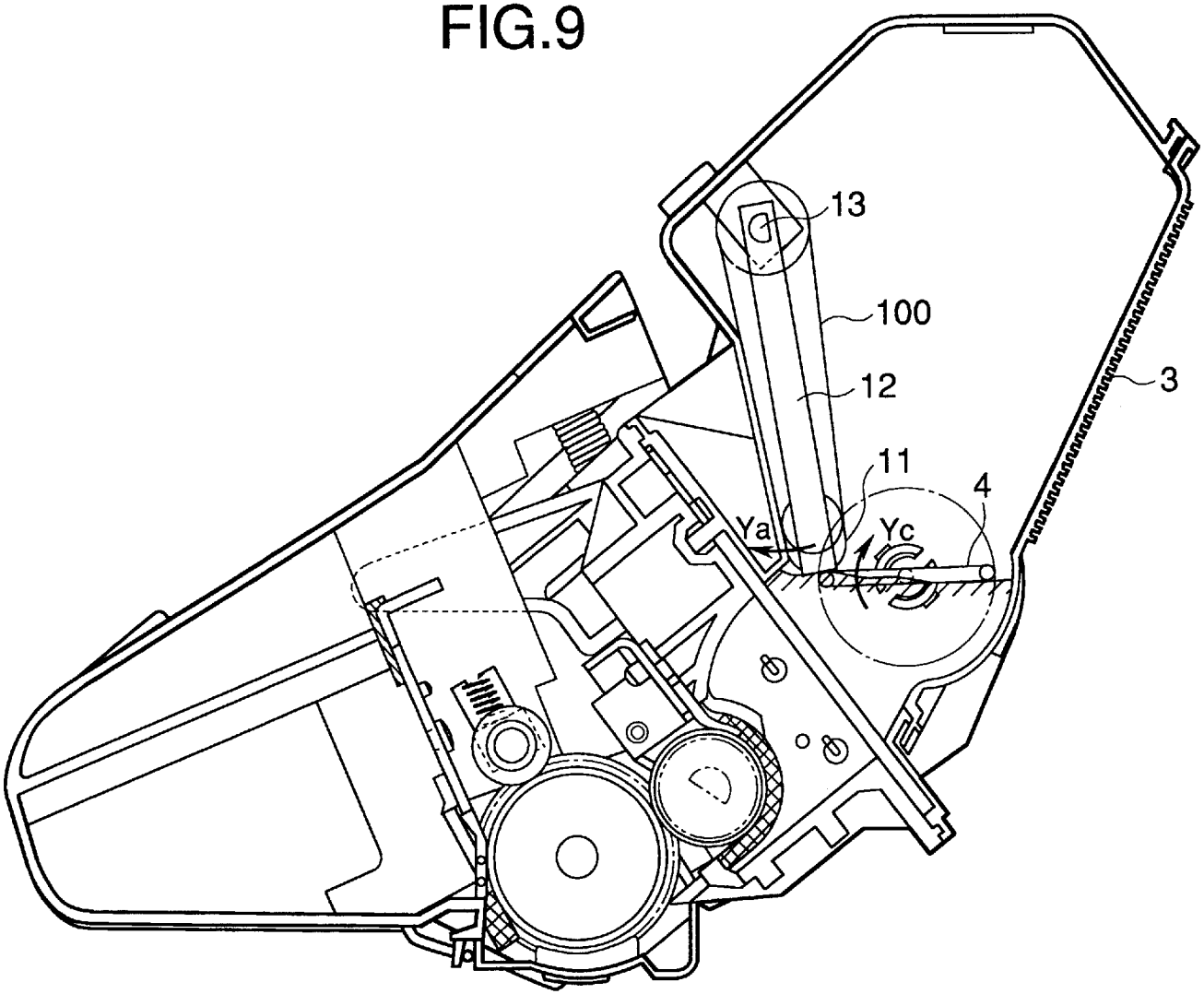
FIG. 9 is a cross-sectional view which shows a process cartridge provided with the toner amount detection apparatus (an apparatus for detecting the amount of developer).

Now, with reference to FIG. 3 and FIGS. 4A to 4C, the description will be made of a second embodiment in accordance with the present invention. Here, FIG. 3 is a view which shows the section of the toner container of a process cartridge of the present invention, as well as the state in which the float moves as the toner is consumed. FIGS. 4A to 4C are views which illustrate the operation of the toner amount continuous detection apparatus (an apparatus for detecting the amount of developer) in accordance with the present invention. Therefore, in FIG. 3 and FIGS. 4A to 4C, the same reference marks are applied to the same constituents as those appearing in FIG. 1 and FIGS. 2A to 2D, and the description thereof will be omitted.

In accordance with the present embodiment, the agitation gear 20 which transmits driving force to the agitation member 4 is arranged to engage with a gear 22 through an idle gear 21. To this gear 22, the contact member 23 is fixed coaxially.

Also, to the end of the float shaft 13, an abutting member 24, which abuts upon the contact member 23 selectively, is fixed coaxially.

Then, the installation positions of the contact members 23 and 24, which are fixed coaxially to the gear 22 and the float shaft 13, are adjusted so that the tips of the contact members abut upon each other when the gear 22 and the float shaft 13 are rotated, respectively. Here, in FIG. 3 and FIGS. 4A to 4C, the gears 20, 21, and 22, and the contact members 23 and 24, and the interior of the toner container 3 are overlapped in the representation thereof. Actually, however, the gears 20, 21, and 22, and the contact members 23 and 24 are installed outside the toner container 3.

As described above, while the float 11 is in a state where it parts from the path of the agitation member 4 sufficiently, the contact members 23 and 24 do not abut upon each other as shown in FIG. 3.

Then, the float 11 is rotated centering on the float shaft 13 to follow the toner surface, which is being lowered as the toner in the toner container 3 is consumed, and when the float 11 is positioned on the path of the agitation member 4 as shown in FIG. 4A, the contact members 23 and 24 abut upon each other before the agitation member 4 is in contact with the float 11. Then, torque is transmitted from the agitation gear 20 to the float shaft 13 through the idle gear 21, the gear 22, and the contact members 23 and 24. Thus, as shown in FIG. 4B, the float 11 is caused to return in the direction in which it has arrived so that the float 11 does not abut upon the agitation member 4.

After that, the abutting state of the contact members 23 and 24 are released when the agitation member 4 has passed to part from the path of the float 11. The float 11 holds the upper surface of toner, hence making it possible to detect the remaining toner exactly.

In this respect, it may be possible to adopt a structure using a cam, a partially toothless gear, or the like, instead of the contact members 23 and 24, as some other method to prevent the float 11 from being in contact with the agitation member 4 which moves in synchronism.

(Third Embodiment)

Now, with reference to the accompanying drawings, a description will be provided of some other embodiments of the toner amount detection apparatus, and one embodiment of the process cartridge that uses such detection apparatus.

In conjunction with FIG. 10 to FIGS. 15A to 15C, a description will be provided of a third embodiment in accordance with the present invention. Here, a description will be provided of the process cartridge and the entire structure used for executing image formation by means of such process cartridge. Then, a description will be provided of the structure of an apparatus for detecting the amount of developer.

(The Entire Structure of Image Formation)

Figure 10:
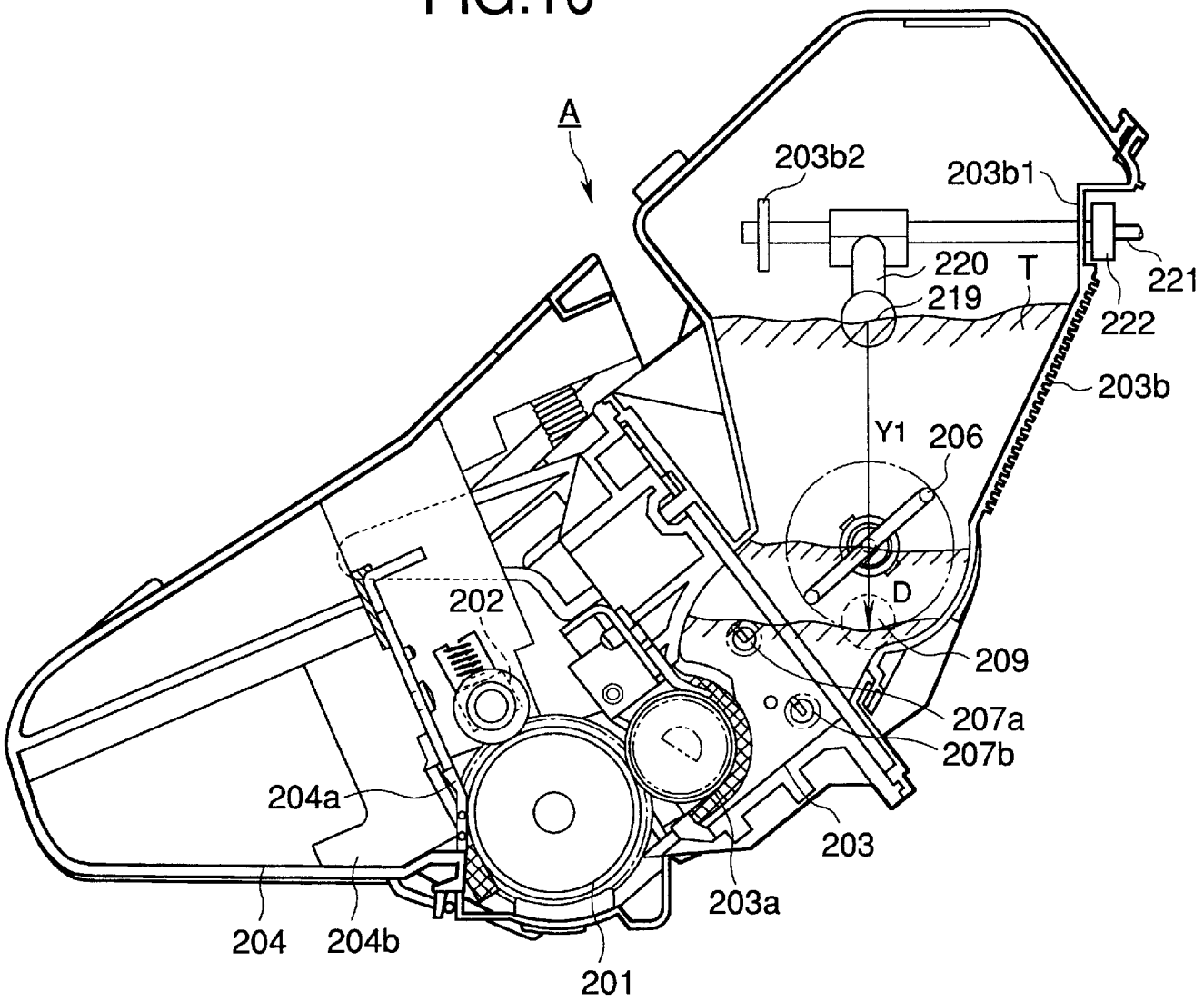
FIG. 10 is a view which illustrates the structure of a process cartridge.
Figure 11:
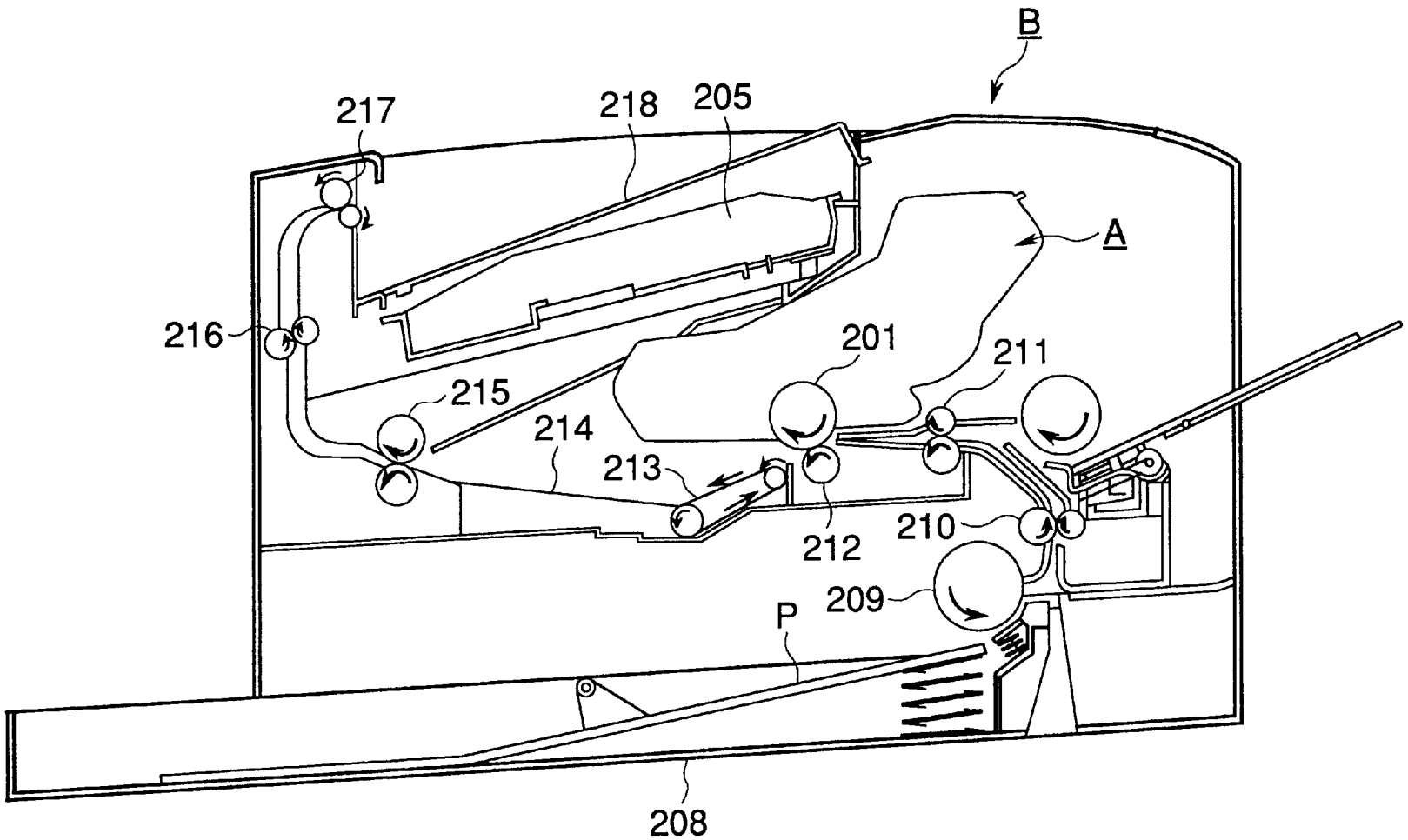
FIG. 11 is a view which illustrates the entire structure of an image formation apparatus having a process cartridge mounted on it.

As shown in FIG. 10, the process cartridge A comprises a photosensitive drum (electrophotographic photosensitive body) 201 which serves as an image carrier; an electrostatic charging roller 202 serving as electrostatic charging means for charging the photosensitive drum 201 evenly; developing means formed by a developing roller 203*a* that makes the latent images, and also, by the toner container 203*b* that contains toner T; a cleaning means 204 formed by the cleaning blade 204*a* and a waste toner container 204*b* for removing the remaining toner on the photosensitive drum 201 after the toner images formed on the photosensitive drum 201 have been transferred to a transfer material P. These are integrally structured in the form of a cartridge. The process cartridge is detachably mounted on an image formation apparatus (laser beam printer) B as shown in FIG. 11.

Now, a description will be provided of the image formation process to form images by mounting the process cartridge A on the apparatus.

At first, the image signals, which are generated by the main body of the image formation apparatus, are converted into laser beams by means of laser scanner 205, and irradiate to the rotating photosensitive drum 201 the surface of which is evenly charged by the electrostatic charging roller 202. In this manner, the latent images are formed. Then, the toner T, which has been agitated by the toner agitation member 206 installed in the toner container 203*b*, is supplied to the developing unit where it is sufficiently made softer by the upper agitator 207*a* and the lower agitator 207*b*. After that, the toner is transferred to the latent image portion irradiated by the laser beams on the photosensitive drum 201, hence forming the toner images.

On the other hand, the transfer material P contained in the cassette 208 is fed by the feed rollers 209 and 210 in synchronism with the aforesaid image formation, and carried to the transfer unit by the resist roller 211 in synchronism with the formation of the toner images. Then, the toner images on the photosensitive drum 201 are transferred to the transfer material P when the voltage, having the reversed polarity of the toner images, is applied to the transfer roller 212, which serves as transfer means.

Thus, the transfer material P is carried to the fixation means 215 by the carrier belt 213 and the guide 214. Here, on the transfer material P, the toner images thus transferred are permanently fixed by the application of heat and pressure. Then, the transfer material is exhausted to the exhaust unit 218 by use of the exhaust rollers 216 and 217.

Meanwhile, the toner which is not transferred to the transfer unit, but still remains on the photosensitive drum 201, is scraped off by the cleaning blade 204*a* to the interior of the waste toner container 204*b* for removal.

(Structure of the Apparatus for Detecting the Amount of Developer)

It is required to replace the process cartridge A when toner in the toner container (developer container) 203*b* is completely consumed. Therefore, in accordance with the present embodiment, the toner remainders detection apparatus (the apparatus for detecting the amount of developer) is installed in developing means 303 in order to detect the remaining toner in the toner container 203*b*. Now, a description will be provided of the structure of the toner remainders detection apparatus.

Figure 12:
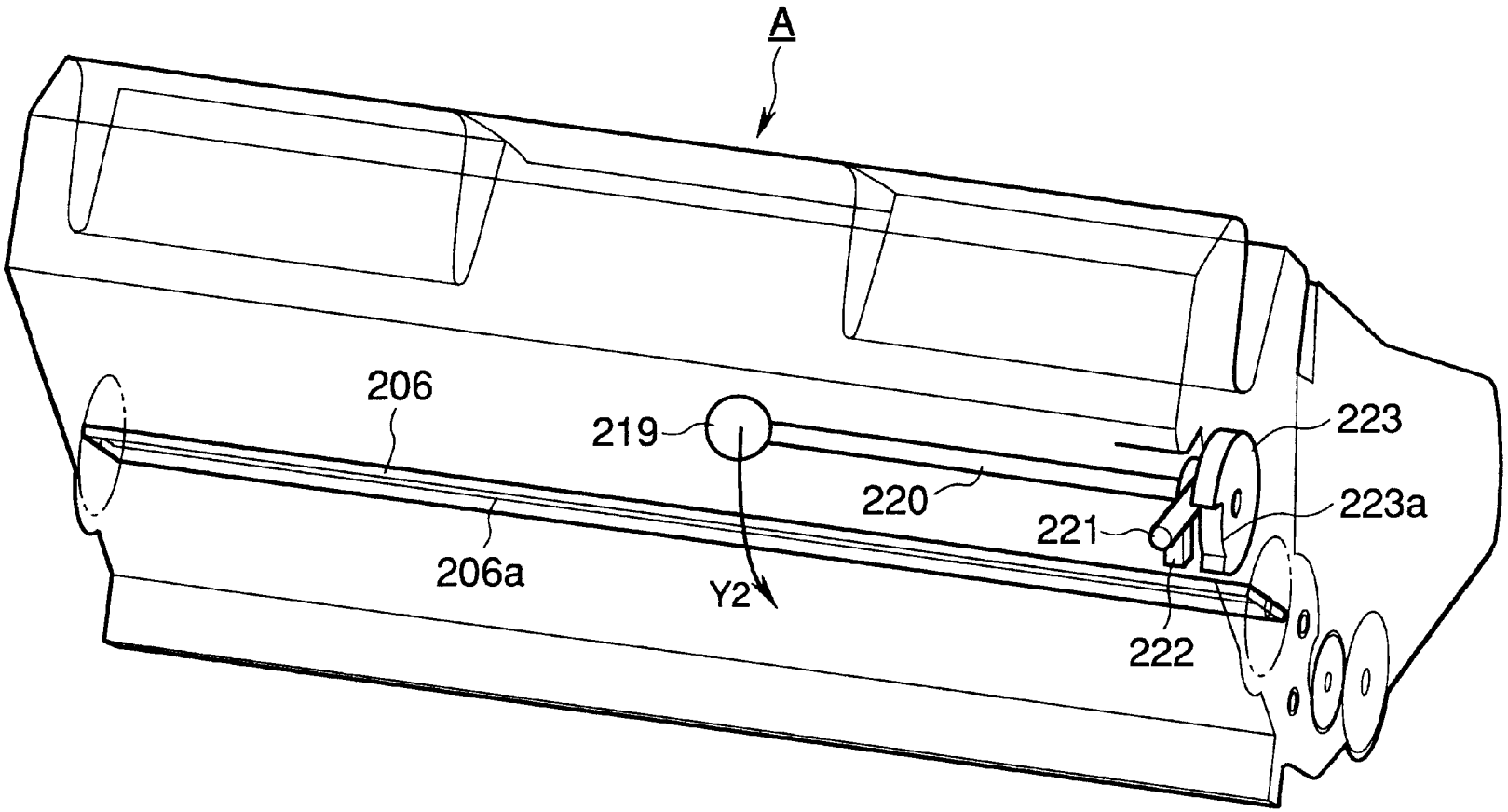
FIG. 12 is a perspective view which illustrates transparently the state of the interior of a process cartridge showing the detection unit thereof.

FIG. 12 is a transparently perspective view which illustrates the interior of the process cartridge, showing the portion of the detection apparatus. In FIG. 12, a reference numeral 219 designates the float which is the movable member following the changes of the upper position of the contained toner, and which is installed in the toner container 203*b* of the process cartridge A. For the toner container 203*b*, there are installed, besides the aforesaid agitation member 206 that agitates the filled-in toner T, an arm 220 which is a swinging member connected with the float 219 to enable the float 219 to swing as described later; and the rotational shaft 221, which is extruded outside the toner container 203*b* and rotatively supports the arm 220 to the toner container 203*b*. Then, as shown in FIG. 10, the rotational shaft 221 is axially supported by the wall 203*b*1 of the toner container 203*b*, and also, by axially supported by the supporting portion 203*b*2 which is formed to be extruded to the interior of the toner container. Also, as shown in FIG. 10, the float 219 is made movable downward vertically in the direction indicated at Y1, which is the direction indicated at a circular Y2 in FIG. 12 showing a perspective view of the process cartridge. Here, in accordance with the present embodiment, a detection member is formed by the float 219 and the arm 220. This detection member is arranged to detect the upper surface of toner contained in the toner container 203*b*.

The rotational shaft 221 and the arm 220 are fixed by fitting by use of a hole and a shaft having a D cut so as not to allow them to rotate. Also, a fitting member 222 is fixed to the rotational shaft 221 outside the toner container 203*b* in the same manner as the arm 220 so that this member cannot be rotated. In other words, it is arranged to fix the angle made by the arm 220 and the fitting member 222.

On the side face of the toner container 203*b*, the cam 223, which is provided with a cut off portion 223*a*, is arranged to be rotative by means of the driving force transmitted from a driving source (not shown) that operates the photosensitive drum 201 or the agitation member 206 of the process cartridge through a gear train or the like. The positional relationship between the cam 223 and the fitting member 222 is arranged to overlap the moving path of the fitting member 222 with the passage of the cut off portion 223*a* of the cam 223. Also, an aperture 206*a* is arranged for the agitation member 206 in order to lower the agitation torque, and to enhance the agitation capability simultaneously.

Figure 13A:
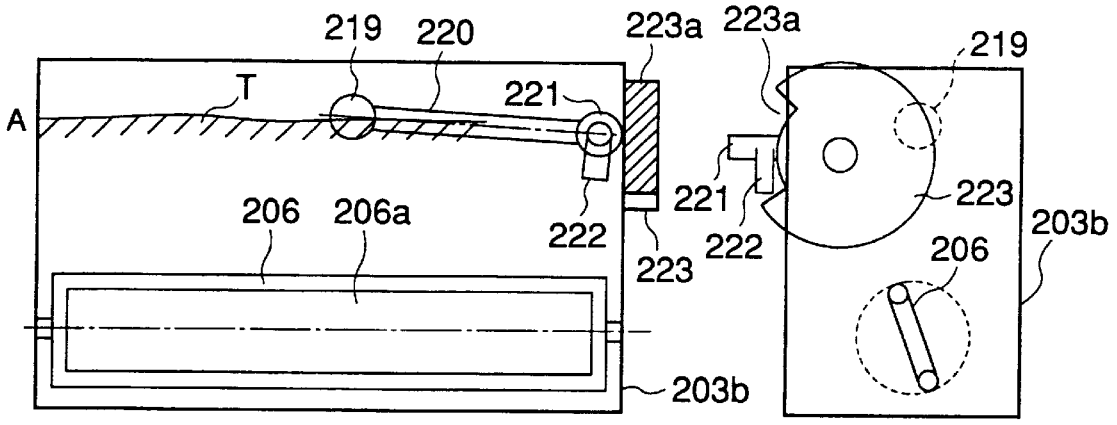
FIGS. 13A and 13B are views which schematically illustrate the state of the interior of a toner container when toner is consumed.
Figure 13B:
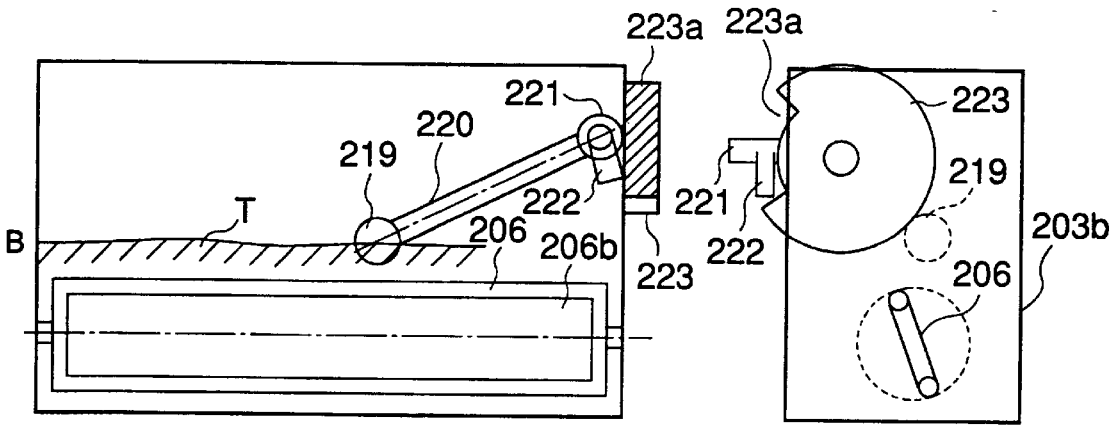

With the structure described above, the operation of the float 219 is as given below when toner is completely consumed:

FIGS. 13A and 13B are views which schematically illustrate the inner state of the toner container when toner is being consumed. From the state before toner is consumed (FIG. 13A), the upper surface of toner shown in FIG. 13A descends to the surface as shown in FIG. 13B along with its consumption. Then, the float 219 on the upper surface of toner also descends following the upper surface of toner in the circular path centering on the rotational shaft 221.

Along with the movement of the float 219, the fitting member 222 is also rotated, because its relative position is fixed with the arm 220 having the float 219 connected therewith. In the state where remaining toner are still larger (where the upper surface of toner moves from the positions at A to B in FIGS. 13A and 13B), the fitting member 222 fixed to the rotational shaft 221 does not interfere in the rotating cam 223 (indicated by the slanted lines in the front views in FIGS. 13A and 13B). However, immediately before the float 219 interferes in the operational range of the agitation member 206 (FIG. 13B), the fitting member 222 begins to interfere in the rotating cam 223.

FIGS. 14A to 14C and FIGS. 15A to 15C are views which schematically illustrate the state where the float 219 swings by means of the cam 223. A cut off portion 223*a* is provided for the cam 223. The cut off portion 223*a* operates to release the engagement between the fitting member 222 and the cam 223 temporarily per rotation of the cam 223, and to engage them again. Further, the movements of the cam 223 and agitation member 206 are synchronized by use of gear train and others. Now, hereunder, the operation thereof will be described in detail.

Figure 14A:
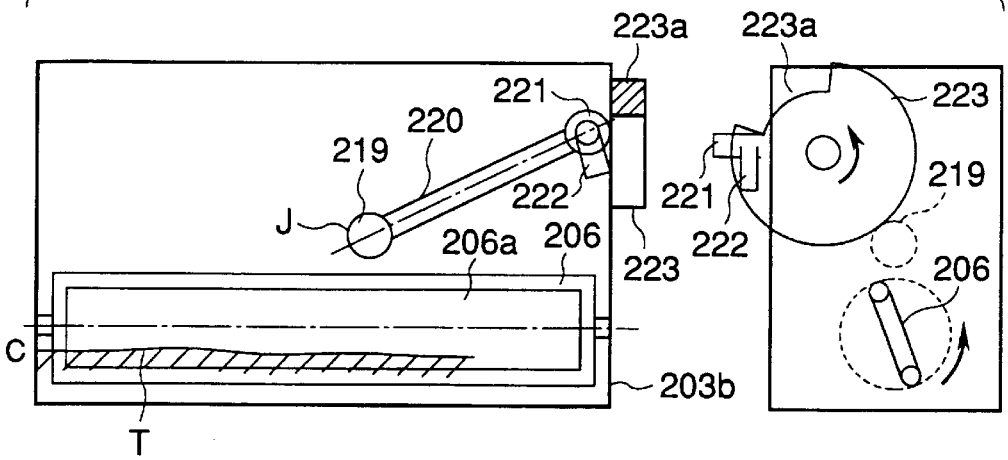
FIGS. 14A, 14B and 14C are views which schematically illustrate the state of a float which swings by means of a cam.
Figure 14B:
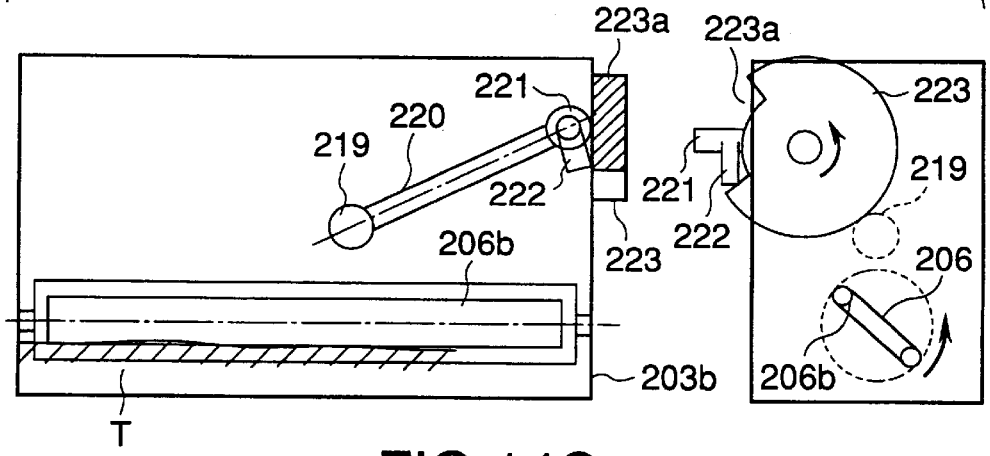
Figure 14C:
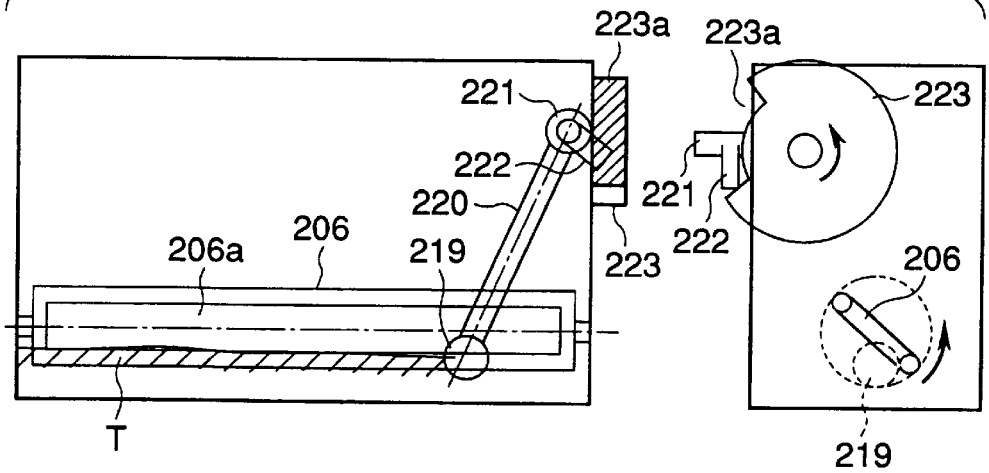

The toner surface is on the level at C in FIG. 14A. The float 219 is retracted to the position at J (upper dead point) higher than the region of the agitating operation (indicated by circle of two-dot chain line). When the cam 223 and the agitation member 206 rotate, the contact between the cam side face 223*b* and the fitting member 222 is released (FIG. 14B) while the edge of the aperture 206*b* of the agitation member 206 is not on the path in which the float 219 (indicated by dotted line in the sectional views in FIGS. 14A to 14C) descends, and then, the float 219 falls down on the toner upper surface (FIG. 14C).

Figure 15A:
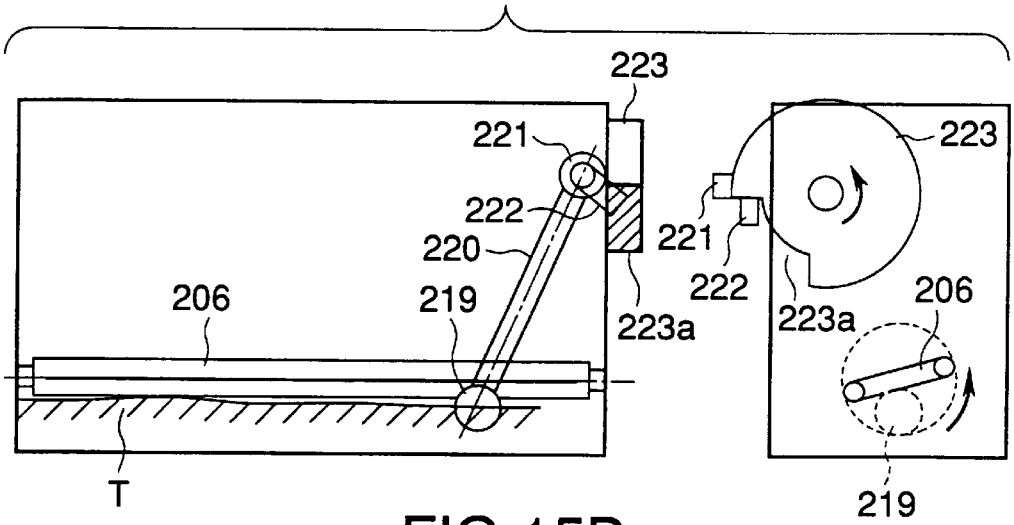
FIGS. 15A, 15B and 15C are views which schematically illustrate the state of a float which swings by means of a cam.
Figure 15B:
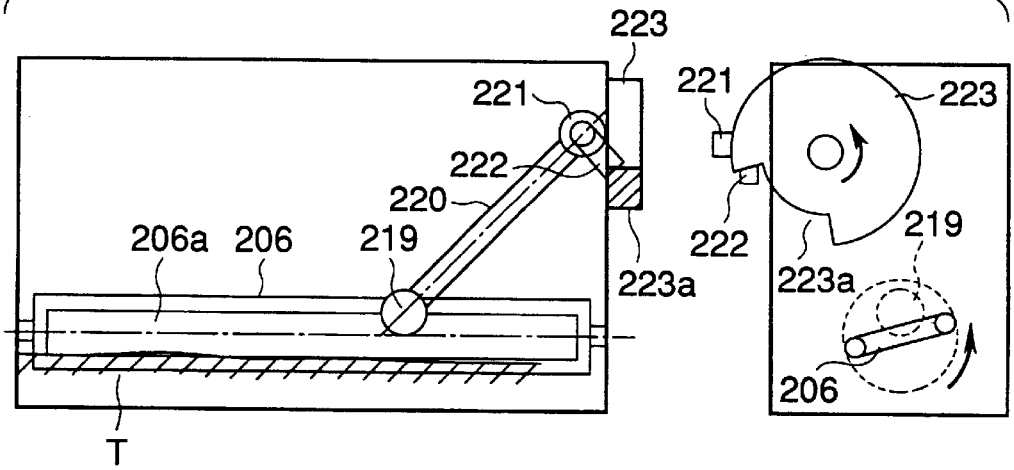
Figure 15C:
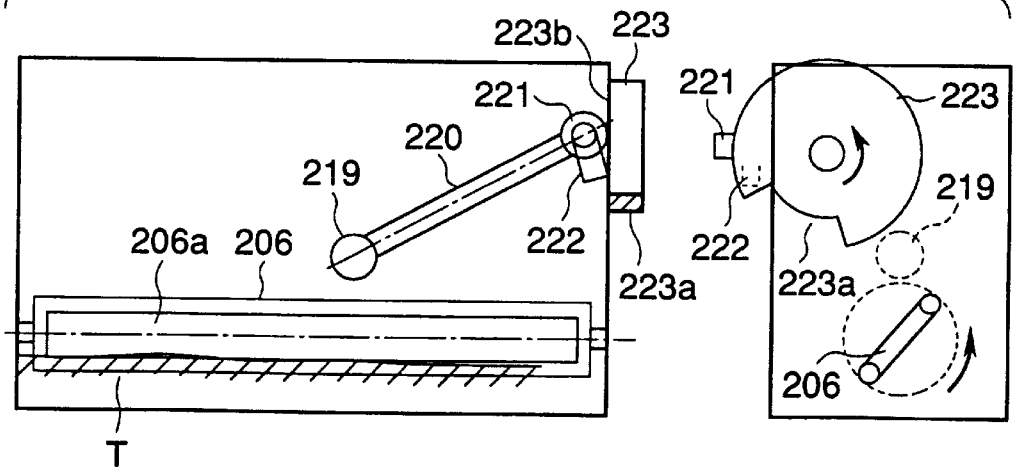

The cam 223 and the agitation member 206 further rotate, and when the edge of the cut off portion 223*a* of the cam and the fitting member 222 are again in contact with each other (FIG. 15A), the cam 223 presses down the fitting member 222. Then, the float 219 is raised (FIG. 15B) so that the agitation member 206 does not interfere in the float 219. Thus, the float 219 is positioned again at the upper dead point J (FIG. 15C).

In other words, the float 219 follows the toner surface which descends gradually, while the float 219 repeating its swinging as described earlier in the position lower than the upper dead point J. The float descends and arrives at the lowest point (the position at D in FIG. 10) to finish the continuous detection of remaining toner.

In this respect, the positional detection of the float 219, namely, detection means for detecting toner remainders, is arranged by a method to count the optical ON/OFF of a disc having holes, which is installed on the rotational shaft 221 externally extruded from the toner container 203*b* or a method to read the rotational amount by means of a potentiometer installed likewise, for example.

With the structure described above, it is possible to perform the toner remainders continuous detection by use of the float 219, while maintaining the conventional structure of the agitation member 206, and the function of agitation as well. Further, by arranging the plane of the float 219 movement to be parallel with the process cartridge in its longitudinal direction, it becomes possible to allow the float 219 to move near to the bottom of the toner container 203*b* (where toner is present up to the last stage as toner remainders becoming smaller in it) as shown in the cross-sectional view in FIG. 10. In other words, it is possible to detect the smaller amount of remaining toner.

In accordance with the present embodiment, it is arranged to swing the float 219 by a mechanism formed by the cam 223 provided with the cut off portion 223*a* and the fitting member 222, but the present invention is not necessarily limited to the use of this mechanism. It may be possible to adopt such mechanism as the one that uses partially toothless gears; the one that uses the cam without any cut off portion but it enables the angle of the fitting member to rotate continuously; or the one that swings the float by means of external driving from the main body of an image formation apparatus, for example, which is a driving unit different from the one used for the process cartridge A, when there is no intervention between the path of the float 219 and the agitation member 206.

Also, if the plane of the float 219 movement is set at the plane that includes the central axis of rotation of the agitation member 206, it becomes possible to provide a longer period of time since the float 219 has begun lowering itself to hold the toner surface up to being raised so as not to be in contact with the agitation member 206. In other words, the temporal clearance is gained here. As a result, the float 219 and the agitation member 206 do not interfere even when the plane of the float 219 movement is deviated from the plate that includes the central axis of rotation of the agitation member 206 at the time of assembling.

(Fourth Embodiment)

Figure 16:
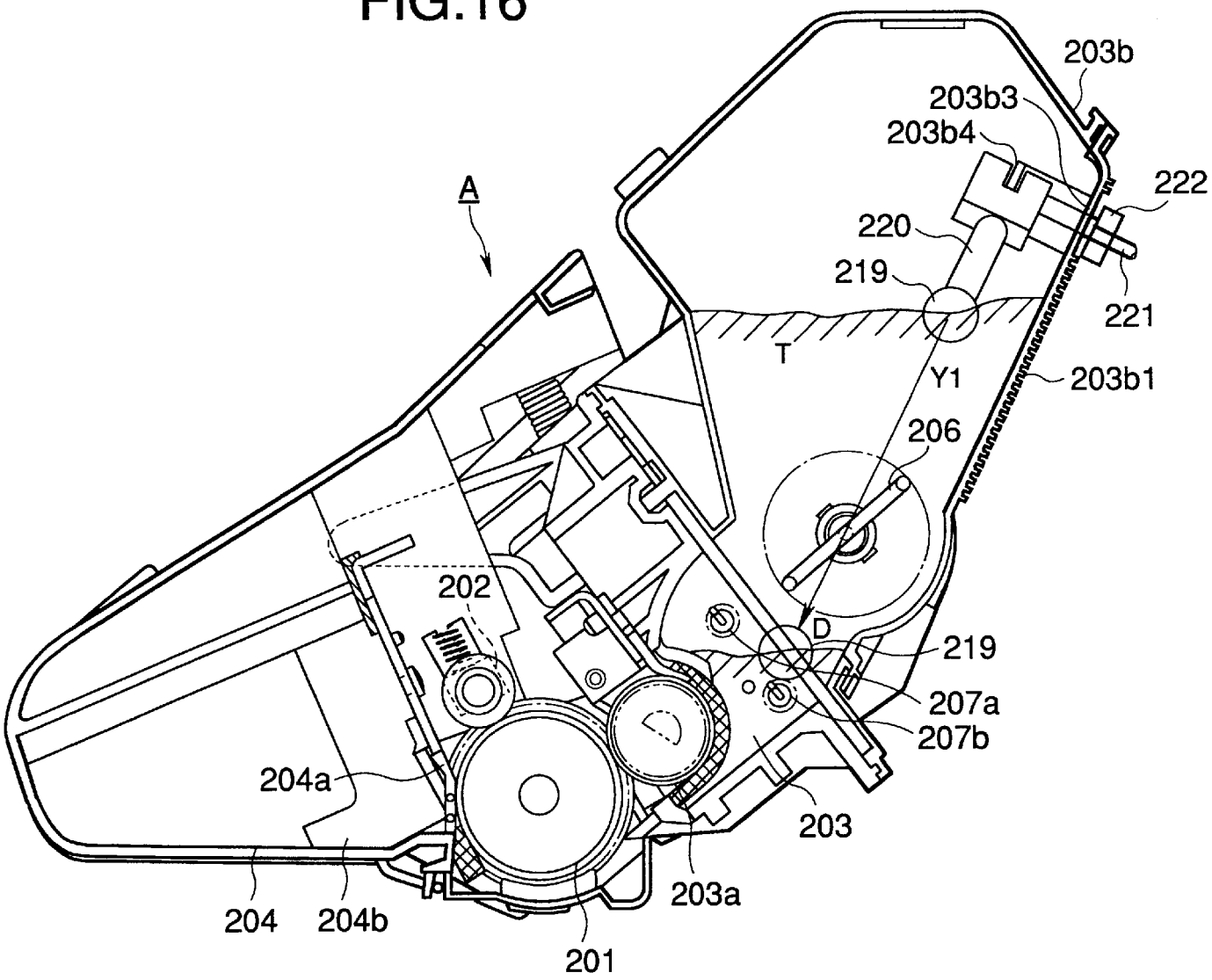
FIG. 16 is a view which illustrates a process cartridge in accordance with a second embodiment of the present invention.

FIG. 16 is a view which illustrates the process cartridge in accordance with a fourth embodiment of the present invention. In this case, too, the float 219 descends following the movement of the toner upper surface, and swings in the same manner as those described in the third embodiment.

However, the rotational shaft 221 is axially supported by the bearings 203*b*3 and 203*b*4 integrally formed on the wall 203*b*1 of the toner container 203*b*. In this way, the plane of the float 219 movement is arranged to be parallel with the wall 203*b*1 of the toner container 203*b*. Then, the lowest point D of the float 219 can be positioned nearer to the bottom than that of the third embodiment. Further, by the adoption of this structure, it becomes possible to make an apparatus for detecting remainders as a unit including the wall 203*b*1 of the toner container 203*b*, the float 219, the arm 220, and the rotational shaft 221, hence improving its the assembling operativity.

As described earlier, the process cartridge is provided with an image carrier, and at least, development means, for example. Therefore, as the embodiments of such process cartridge, there are, besides the embodiments described above, the one having the image carrier, the developing means, and the electrostatic charging means formed integrally in a cartridge, which is detachably mountable on the main body of an apparatus or the one having the image carrier, the developing means, and the cleaning means integrally formed in a cartridge, which is detachably mountable on the main body of an apparatus, among some others.

Further, a laser printer is exemplified as the image formation apparatus for the embodiments which have been described above. The present invention, however, is not limited to those embodiments. The invention is of course applicable to an electronic photographing copying machine, a facsimile equipment, for example, or some other image formation apparatuses, such as word processor.

(Fifth Embodiment)

Now, with reference to the accompanying drawings, a description will be provided of a fifth embodiment in accordance with the present invention.

Figure 17:
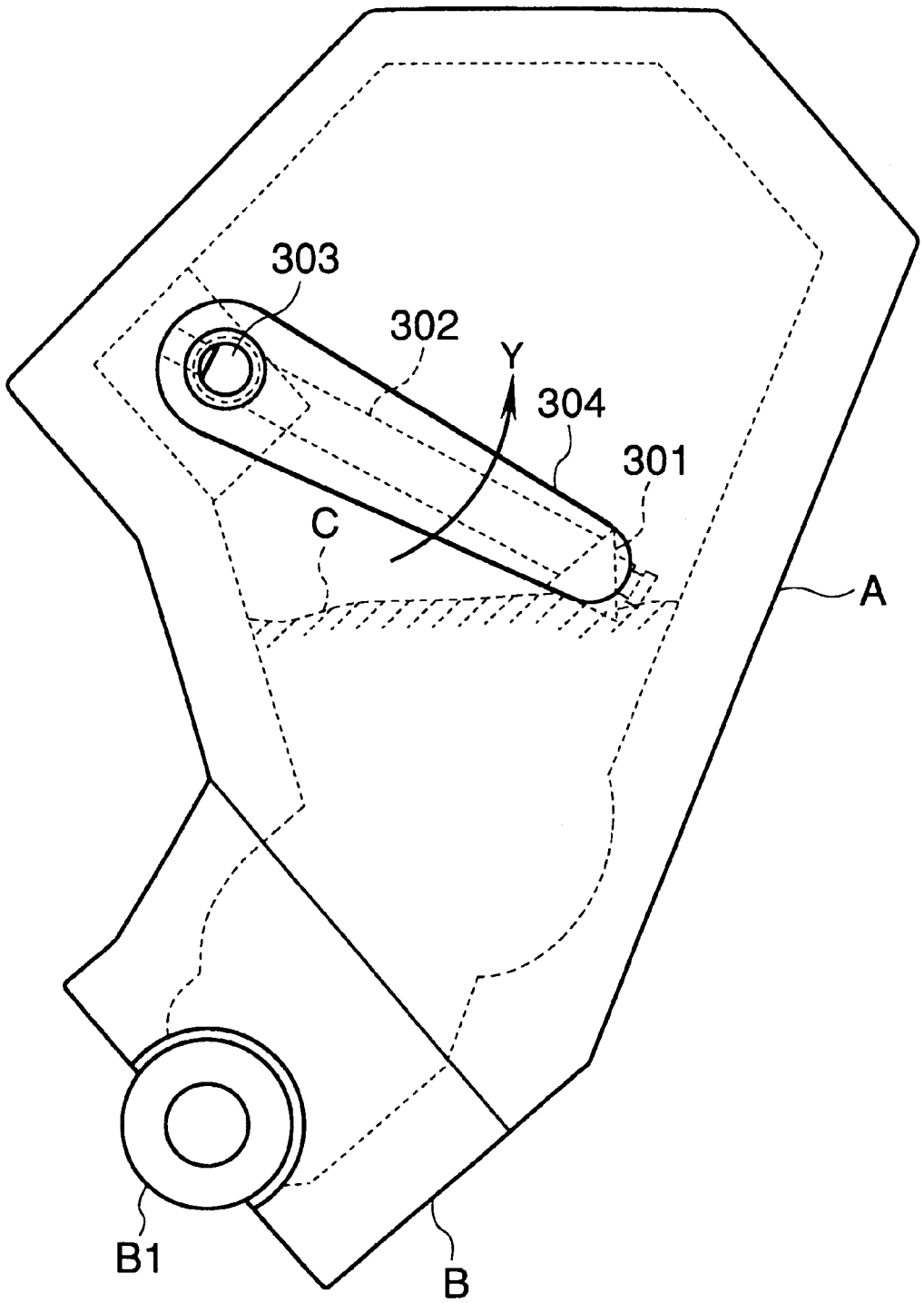
FIG. 17 is a side view of a toner container which schematically shows the structure of an apparatus for detecting the amount of developer.
Figure 18:
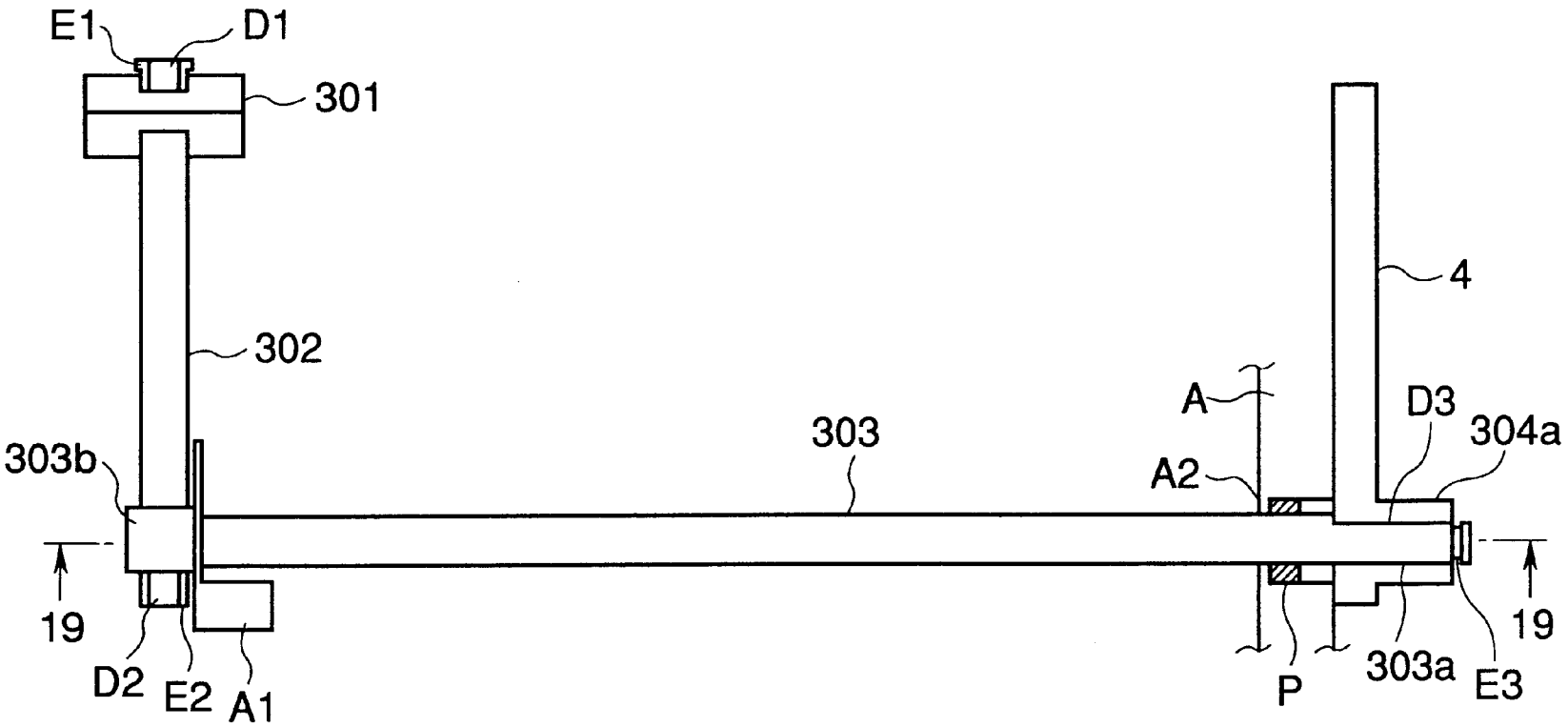
FIG. 18 is a cross-sectional view which shows the apparatus for detecting the amount of developer in its longitudinal direction.
Figure 19:
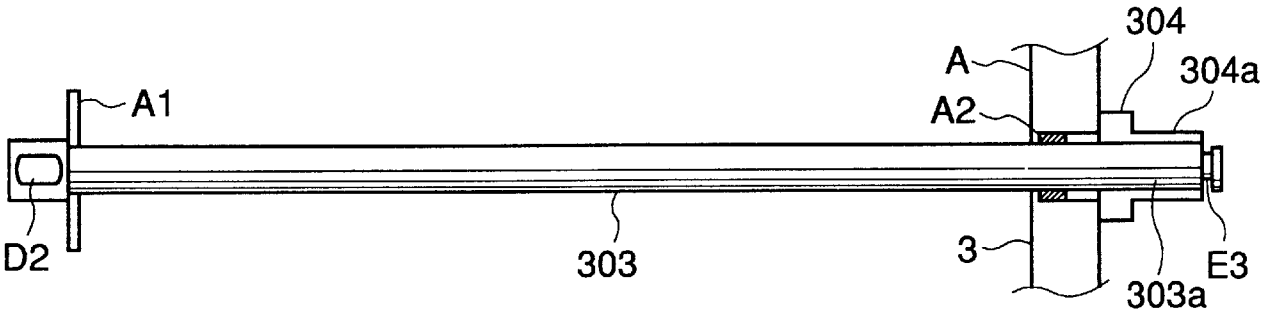
FIG. 19 is a cross-sectional view, taken along line 19—19 in FIG. 18.
Figure 20:
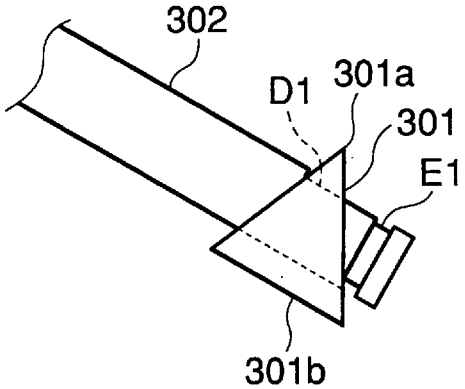
FIG. 20 is an enlargement of the detailed view which shows the float portion of an apparatus for detecting the amount of toner.

FIG. 17 is a side view of a toner container, which schematically shows the structure of an apparatus for detecting the amount of developer in accordance with a fifth embodiment of the present invention. FIG. 18 is a cross-sectional view of the apparatus for detection the amount of developer, taken in the longitudinal direction. FIG. 19 is a cross-sectional view taken along line 19—19 in FIG. 18.

In FIG. 17, a reference mark A designates a toner container, and B, a developing device. Toner C in the toner container A moves to the developing device B and adheres to the development sleeve B1 by the application of magnetic force, and then, moves to the electrostatically charged photosensitive drum (not shown) by the application of the electromagnetic force having development bias.

The float 301 is fixed to the float arm 302 by use of an E ring or screws (FIG. 18 shows an E ring engagement groove E1, for example). Then, the D cut D1 or the like is used for fitting. Therefore, the float 301 is fixed to the float arm 302 in order to disable its rotation. Also, the float arm 302 is coupled with the float shaft 303 by use of screws or the like (FIG. 18 shows only the male screw E2, for example). Then, the D cut D2 or the like is used for fitting. The float arm 302 is fixed to the float shaft 303 in order to disable its rotation. Therefore, the float 301 is rotatively supported centering on the float shaft 303.

Here, in accordance with the present embodiment, the detection member is structured by the float 301 and the float arm 302. The detection member is arranged to detect the upper surface of toner contained in the toner container.

Also, as shown in FIG. 18, the end 303*a* of the float shaft 303 is coupled with the recovery lever 304 outside the toner container A by use of the D cut D3 so that the float shaft is not allowed to rotate. Thus, when the user rotates the recovery lever 304 in the direction indicated by an arrow Y in FIG. 17, the float 301, which is buried in the toner C, is brought up to appear on the upper surface of the toner C. Also, to the boss 304*a* of the recovery lever 304, an angle sensor (not shown) is coupled from outside the toner container A. In this way, the position of the rotating float 301 is read by the angle sensor. The position of the float 301 is transmitted to the image formation apparatus. With the current position of the float 301, the user is able to acquire the current remainder of toner C continuously.

Here, the recovery lever 304 is coupled with the E ring or screws (FIG. 18 and FIG. 19 illustrate the fitting groove E3 of the E ring, for example) on the end portion 302*a* of the float shaft 303. Thus, the recovery lever 304 is prevented from falling off in the thrust direction of the float shaft 303. Further, the other end portion 303*b* of the float shaft 303 is provided with steps, and functions as the thrust bearing with a part Al of the toner container A which supports the float shaft 303. Also, a packing P is filled in between a part A2 of the toner container A that supports the float shaft 303, and the float shaft 303 in order to prevent the toner C from leaking outside.

FIG. 19 is an enlarged view of the float 301 portion. As shown in FIG. 19, the section of the float 301 is in the form of a triangle in its advancing direction. This portion has an acutely angled part 301*a* in the front along the moving direction indicated by an arrow Y (see FIG. 17), and the flat portion 301*b* on the rear, respectively.

Here, as described earlier, the float arm 302 and the recovery lever 304 are coupled, and its rotation is disabled with respect to the float shaft 303. As a result, the recovery lever 304 faces downward if the float 301 is buried in the toner C as shown in FIG. 21A in the case where the float arm 302 and the recovery lever 304 are arranged at the same angle as shown in FIG. 17.

Figure 21A:
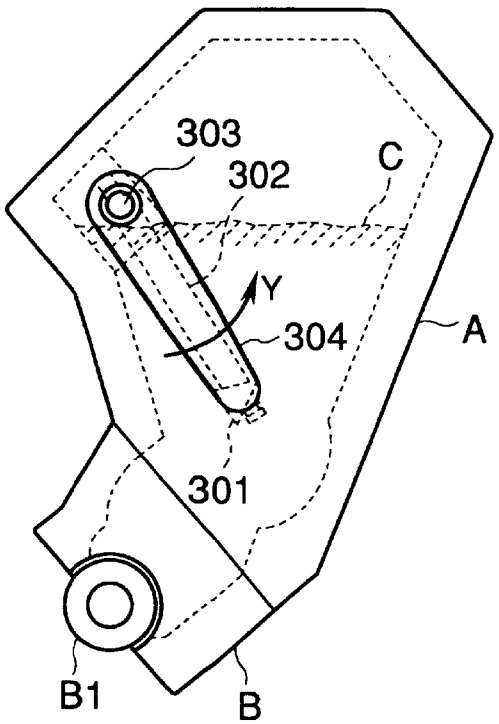
FIGS. 21A, 21B and 21C are side views of a toner container which illustrate the state of a float being recovered in the toner.

Then, the user rotates the recovery lever 304 in the direction indicated by the arrow Y in FIG. 21A before the process cartridge is mounted on the main body of the image formation apparatus in order to allow the float 301 to appear on the upper surface of toner C. At this juncture, the float 301 is caused to move with its acutely angled portion 301*a* which is on the front in its advancing direction. As a result, the resistance force acting upon the float 301 is suppressed to be smaller than that exerted on the float whose section is circular when the float moves in the toner C.

Figure 21B:
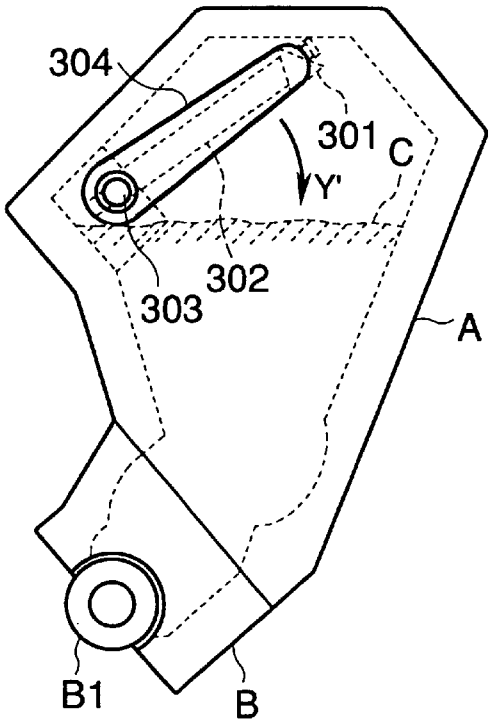
Figure 21C:
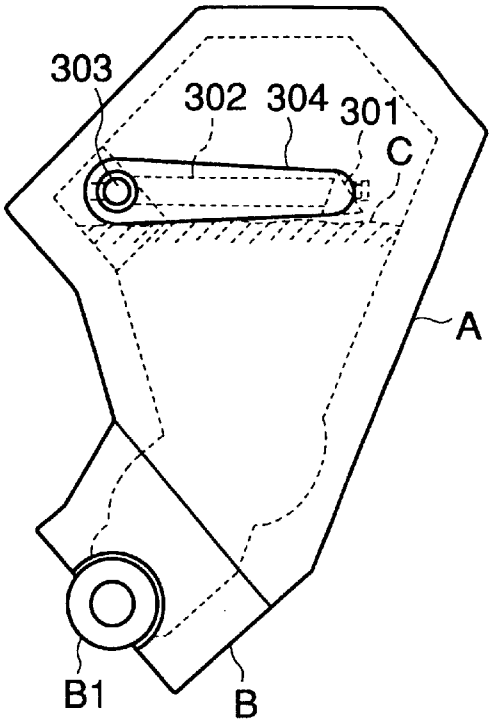

Also, as shown in FIG. 21B, if the float 301 is positioned higher than the upper surface of the toner C, the user releases the recovery lever 304 to fall down in the direction Y' which is opposite to the direction indicated by the arrow Y. At this juncture, the float 301 falls down with its plane portion 301*b* on the front in its advancing direction. Therefore, as shown in FIG. 21C, the float 301 is substantially in contact with the upper surface of toner C, and the force received from the toner C is greater than the force that may be received by the float whose section is circular. In this way, the float 301 is not buried in the toner C.

In this way, the float 301 can hold the upper surface of the toner C reliably before the process cartridge is mounted on the main body of the image formation apparatus.

Then, with the float 301 being held on the upper surface of the toner C, the process cartridge is mounted on the main body of the image formation apparatus. Thereafter, the float 301 is able to hold the upper surface of the toner C continuously and reliably even when the upper surface of the toner C is lowered as it is consumed, hence making it possible to detect remainders continuously in high precision. Here, the information of the remainder of the toner C is transmitted to the main body of the image formation apparatus, because the angle sensor (not shown) detects the angular changes of the float shaft 303 (or the recovery lever 304), and the information is indicated on the display of the main body accordingly.

Also, even if the process cartridge is once removed from the image formation apparatus due to the absence of images or the like, the float 301 can be held reliably on the upper surface of the toner C again by rotating the recovery lever 304 as described earlier. This makes it possible to carry on the continuous detection of remainders in high precision.

Here, the structure, in which the float 301 is configured in the form of a triangular column (its section is made triangular), may be applicable to the first to fourth embodiments described above.

In accordance with the first to fifth embodiments that have been described above, the apparatus for detecting the amount of developer is as follows:

An apparatus for detecting an amount of developer, comprises an agitation member for agitating developer contained in a developer container; and a detection member for detecting a position of an upper surface of the developer contained in the developer container, the detection member being interlocked with the agitating operation of the agitation member to move above the upper surface of the developer.

Also, the detection member is interlocked with the agitating operation of the agitation member to move above the upper surface of the developer when the developer contained in the developer container is reduced to a predetermined amount or less.

Also, the detection member is interlocked with the agitating operation of the agitation member to move intermittently above the upper surface of the developer.

Also, the detection member is interlocked with the agitating operation of the agitation member to move intermittently above the upper surface of the developer by abutting of the agitation member on the detection member intermittently.

Also, the detection member moves following reduction of the developer contained in the developer container, and stops in a position not to hinder the agitating operation of the agitation member.

Also, the detection member is interlocked with the agitating operation of the agitation member to move above the upper surface of the developer by transmitting the driving force thereto from a driving member for driving the agitation member.

Also, the detection member is interlocked with the agitating operation of the agitation member to move intermittently above the upper surface of the developer by transmitting the driving force thereto intermittently from the driving member for driving the agitation member, without interfering with the agitation member.

Also, the detection member is interlocked with the agitating operation of the agitation member to move to a position not to interfere with the agitation member.

Further, an apparatus for detecting an amount of developer, comprises an agitation member for agitating developer contained in a developer container; and a detection member for detecting the position of the upper surface of the developer contained in the developer container, a leading end of the detection member being movable in an operational region of the agitation member.

Also, the detection member is rotatable with respect to the developer container, and the leading end of the detection member is linearly movable in longitudinal direction thereof.

Here, the detection member is interlocked with the agitating operation of the agitation member to move when the developer contained in the developer container is reduced to a predetermined amount or less.

Also, the detection member is interlocked with the agitating operation of the agitation member to move above the upper surface of the developer by transmitting the driving force thereto from a driving member for driving the agitation member.

Also, the detection member is interlocked with the agitating operation of the agitation member to move intermittently above the upper surface of the developer without interfering with the agitation member by transmitting the driving force intermittently from the driving member for driving the agitation member.

Also, the detection member is interlocked with the agitating operation of the agitation member to move to the position not to interfere with the agitation member.

Furthermore, an apparatus for detecting an amount of developer, includes a detection member for detecting a position of an upper surface of developer contained in a developer container, a leading end of the detection member being substantially in the form of a triangular column.

Also, the leading end of the detection member is provided with two acutely angled portions on the downstream side, and with one acutely angle portion on the upstream side, in a moving direction of the detection member to move along with the reduction of the developer.

Also, the detection member is swingable with respect to the developer container.

What is claimed is:

1. An apparatus for detecting an amount of developer, comprising:

an agitation member for agitating developer contained in a developer container; and a detection member for detecting a position of an upper surface of the developer contained in the developer container, said detection member being interlocked with an agitating operation of said agitation member to move above the upper surface of the developer when the amount of developer contained in the developer container is reduced to a predetermined amount or less by transmitting a driving force thereto from a driving member for driving said agitation member.

2. An apparatus for detecting the amount of developer according to claim 1, wherein said detection member is interlocked with the agitating operation of said agitation member to move intermittently above the upper surface of the developer.

3. An apparatus for detecting the amount of developer according to claim 1, wherein said detection member is interlocked with the agitating operation of said agitation member to move intermittently above the upper surface of the developer by abutting of said agitation member on said detection member intermittently.

4. An apparatus for detecting the amount of developer according to claim 1, wherein said detection member moves following a reduction of the amount of developer contained in the developer container, and stops in a position not to hinder the agitating operation of said agitation member.

5. An apparatus for detecting the amount of developer according to claim 1, wherein said detection member is interlocked with the agitating operation of said agitation member to move intermittently above the upper surface of the developer by transmitting the driving force thereto intermittently from the driving member for driving said agitation member, without interfering with said agitation member.

6. An apparatus for detecting the amount of developer according to claim 1, wherein said detection member is interlocked with the agitating operation of said agitation member to move to a position not interfering with said agitation member.

7. An apparatus for detecting an amount of developer, comprising:

an agitation member for agitating developer contained in a developer container; and a detection member for detecting the position of an upper surface of the developer contained in the developer container, a leading end of said detection member being movable in an operational region of said agitation member, wherein said detection member is rotatable with respect to said developer container, and the leading end of said detection member is linearly movable in a longitudinal direction thereof.

8. An apparatus for detecting the amount of developer according to claim 7, wherein said detection member is interlocked with an agitating operation of said agitation member to move when the amount of developer contained in the developer container is reduced to a predetermined amount or less.

9. An apparatus for detecting the amount of developer according to claim 8, wherein said detection member is interlocked with the agitating operation of said agitation member to move above the upper surface of the developer by transmitting a driving force thereto from a driving member for driving said agitation member.

10. An apparatus for detecting the amount of developer according to claim 9, wherein said detection member is interlocked with the agitating operation of said agitation member, to move intermittently above the upper surface of the developer without interfering with said agitation member, by transmitting the driving force intermittently from the driving member for driving said agitation member.

11. An apparatus for detecting the amount of developer according to claim 7, wherein said detection member is interlocked with an agitating operation of said agitation member to move to a position not to interfere with said agitation member.

12. An apparatus for detecting an amount of developer, including:

a detection member for detecting a position of an upper surface of developer contained in a developer container, wherein a leading end of said detection member is substantially in the form of a triangular column.

13. An apparatus for detecting the amount of developer according to claim 12, wherein the leading end of said detection member is provided with two acutely angled portions on the downstream side thereof, and with one acutely angle portion on the upstream side thereof, in a moving direction of said detection member to move along with a reduction of the developer.

14. An apparatus for detecting the amount of developer according to claim 13, wherein said detection member is swingable with respect to the developer container.

15. A process cartridge detachably mountable on a main body of an image formation apparatus, comprising:

an electrophotographic photosensitive body;

processing means for acting upon said electrophotographic photosensitive body; and an apparatus for detecting an amount of developer, said apparatus having:

(a) an agitation member for agitating developer contained in a developer container; and (b) a detection member for detecting a position of an upper surface of the developer contained in the developer container, said detection member being interlocked with an agitating operation of said agitation member to move above the upper surface of the developer when the amount of developer contained in the developer container is reduced to a predetermined amount or less by transmitting a driving force thereto from a driving member for driving said agitation member.

16. A process cartridge detachably mountable on a main body of an image formation apparatus, comprising:

an electrophotographic photosensitive body;

processing means for acting upon said electrophotographic photosensitive body; and an apparatus for detecting an amount of developer, said apparatus having:

(a) an agitation member for agitating developer contained in a developer container: and (b) a detection member for detecting a position of an upper surface of the developer contained in the developer container, a leading end of said detection member being movable in an operational region of said agitation member, wherein said detection member is rotatable with respect to the developer container, and the leading end of said detection member is linearly movable in a longitudinal direction thereof.

17. A process cartridge detachably mountable on main body of an image formation apparatus, comprising:

an electrophotographic photosensitive body;

processing means for acting upon said electrophotographic photosensitive body; and an apparatus for detecting an amount of developer, said apparatus having:

a detection member for detecting a position of an upper surface of the developer contained in a developer container, a leading end of said detection member being substantially in a form of a triangular column.

* * * * *

UNITED STATES PATENT AND TRADEMARK OFFICE

CERTIFICATE OF CORRECTION

PATENT NO. : 6,041,196

DATED : March 21, 2000

INVENTOR(S) : Takao NAKAGAWA, et al.

It is certified that error appears in the above-identified patent and that said Letters Patent is hereby corrected as shown below:

On the Cover Page at Section [57] in the Abstract:

Line 8, "of the" should be deleted.
Line 10, "become" should read --becomes--.

COLUMN 1:

Line 26, "apparatus:" should read --apparatus,-- and "machine," should read --machine:--.
Line 28, "serve" should read --serves--.

COLUMN 4:

Line 19, "an" should be deleted.

COLUMN 5:

Line 5, "electrical" should read --an electrical--.

COLUMN 6:

Line 8, "them" should read --it--.

UNITED STATES PATENT AND TRADEMARK OFFICE

CERTIFICATE OF CORRECTION

PATENT NO. : 6,041,196

DATED : March 21, 2000

INVENTOR(S) : Takao NAKAGAWA, et al.

It is certified that error appears in the above-identified patent and that said Letters Patent is hereby corrected as shown below:

COLUMN 7:

Line 41, "to" should be deleted.

COLUMN 8:

Line 29, "by" should be deleted.

COLUMN 9:

Line 6, "are" should read --is--.
Line 44, "repeating" should read --repeats--.

COLUMN 10:

Line 8, "it enables" should read --enabling--.
Line 43, "the" should be deleted.

UNITED STATES PATENT AND TRADEMARK OFFICE

CERTIFICATE OF CORRECTION

PATENT NO. : 6,041,196

DATED : March 21, 2000

INVENTOR(S) : Takao NAKAGAWA, et al.

It is certified that error appears in the above-identified patent and that said Letters Patent is hereby corrected as shown below:

COLUMN 15

Line 15, "angle" should read --angled--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*